US011448431B1

(12) United States Patent
Davis et al.

(10) Patent No.: US 11,448,431 B1
(45) **Date of Patent: *Sep. 20, 2022**

(54) THERMAL MANAGEMENT SYSTEMS FOR EXTENDED OPERATION

(71) Applicant: Booz Allen Hamilton Inc., McLean, VA (US)

(72) Inventors: James A. Davis, San Diego, CA (US); Igor Vaisman, Carmel, TN (US); Joshua Peters, Knoxville, TN (US)

(73) Assignee: Booz Allen Hamilton Inc., McLean, VA (US)

( * ) Notice: Subject to any disclaimer, the term of this patent is extended or adjusted under 35 U.S.C. 154(b) by 250 days.

This patent is subject to a terminal disclaimer.

(21) Appl. No.: 16/666,851

(22) Filed: Oct. 29, 2019

Related U.S. Application Data

(60) Provisional application No. 62/754,084, filed on Nov. 1, 2018.

(51) Int. Cl.
*F25B 9/00* (2006.01)
*F25B 7/00* (2006.01)
*F25B 1/00* (2006.01)

(52) U.S. Cl.
CPC ..... *F25B 9/006* (2013.01); *F25B 1/005* (2013.01); *F25B 7/00* (2013.01)

(58) Field of Classification Search
CPC ..... F25B 9/006; F25B 7/00; F25B 1/005
USPC ..... 62/114
See application file for complete search history.

(56) References Cited

U.S. PATENT DOCUMENTS

| | | | |
|---|---|---|---|
| 1,836,318 | A | 12/1931 | Gay |
| 2,489,514 | A | 11/1949 | Benz |
| 2,526,221 | A | 10/1950 | Goddard |
| 2,785,540 | A | 3/1957 | Biehn |
| 3,300,996 | A | 1/1967 | Atwood |
| 3,468,421 | A | 9/1969 | Hazel et al. |
| 3,542,338 | A | 11/1970 | Scaramucci |
| 3,685,310 | A | 8/1972 | Bitter et al. |
| 3,789,583 | A | 2/1974 | Smith |
| 3,866,427 | A | 2/1975 | Rothmayer et al. |
| 4,015,439 | A | 4/1977 | Stern |
| 4,016,657 | A | 4/1977 | Passey |
| 4,054,433 | A | 10/1977 | Buffiere et al. |
| 4,151,724 | A | 5/1979 | Garland |
| 4,169,361 | A | 10/1979 | Baldus |
| 4,275,570 | A | 6/1981 | Szymaszek et al. |
| 4,323,109 | A | 4/1982 | Jaster |
| 4,352,272 | A | 10/1982 | Taplay |
| 4,419,865 | A | 12/1983 | Szymaszek |
| 4,539,816 | A | 9/1985 | Fox |

(Continued)

OTHER PUBLICATIONS

U.S. Appl. No. 16/666,859, filed Oct. 29, 2019, Davis et al.

(Continued)

*Primary Examiner* — Ana M Vazquez
(74) *Attorney, Agent, or Firm* — Fish & Richardson P.C.

(57) ABSTRACT

Thermal management systems include an open circuit refrigeration system featuring a first receiver configured to store a gas, a second receiver configured to store a liquid refrigerant fluid, an evaporator configured to extract heat from a heat load that contacts the evaporator, and an exhaust line, where the first receiver, the second receiver, the evaporator, and the exhaust line are connected to provide a refrigerant fluid flow path.

39 Claims, 16 Drawing Sheets

(56) References Cited

U.S. PATENT DOCUMENTS

| | | | |
|---|---|---|---|
| 4,870,830 | A | 10/1989 | Hohenwarter et al. |
| 4,969,495 | A | 11/1990 | Grant |
| 5,094,277 | A | 3/1992 | Grant |
| 5,127,230 | A | 7/1992 | Nesser et al. |
| 5,176,008 | A | 1/1993 | Steenburgh, Jr. |
| 5,187,953 | A | 2/1993 | Mount |
| 5,245,840 | A | 9/1993 | Steenburgh, Jr. |
| 5,297,392 | A | 3/1994 | Takata et al. |
| 5,325,894 | A | 7/1994 | Kooy et al. |
| 5,353,603 | A | 10/1994 | Outlaw et al. |
| 5,360,139 | A | 11/1994 | Goode |
| 5,471,848 | A | 12/1995 | Major et al. |
| 5,513,961 | A | 5/1996 | Engdahl et al. |
| 5,690,743 | A | 11/1997 | Murakami et al. |
| 5,762,119 | A | 6/1998 | Platz et al. |
| 5,974,812 | A | 11/1999 | Kátai et al. |
| 6,044,647 | A | 4/2000 | Drube et al. |
| 6,076,360 | A | 6/2000 | Viegas et al. |
| 6,230,518 | B1 | 5/2001 | Hahn et al. |
| 6,314,749 | B1 | 11/2001 | Steenburgh, Jr. |
| 6,354,088 | B1 | 3/2002 | Emmer et al. |
| 6,381,972 | B1 | 5/2002 | Cotter |
| 6,474,101 | B1 | 11/2002 | Quine et al. |
| 6,564,578 | B1 | 5/2003 | Fischer-Calderon |
| 6,964,168 | B1 | 11/2005 | Pierson et al. |
| 7,377,126 | B2 | 5/2008 | Gorbounov et al. |
| 7,497,180 | B2 | 3/2009 | Karlsson et al. |
| 7,891,197 | B2 | 2/2011 | Winter |
| 7,987,685 | B2 | 8/2011 | Oshitani et al. |
| 9,267,645 | B2 | 2/2016 | Mackey |
| 9,791,221 | B1 | 10/2017 | Litch |
| 10,612,821 | B1 | 4/2020 | Fernando |
| 10,746,440 | B2 * | 8/2020 | Donovan ..... F25B 40/00 |
| 11,112,155 | B1 | 9/2021 | Vaisman et al. |
| 11,168,925 | B1 | 11/2021 | Vaisman et al. |
| 2002/0148225 | A1 | 10/2002 | Lewis |
| 2002/0157407 | A1 | 10/2002 | Weng |
| 2004/0123624 | A1 | 7/2004 | Ohta et al. |
| 2005/0060970 | A1 | 3/2005 | Polderman |
| 2005/0201429 | A1 | 9/2005 | Rice et al. |
| 2006/0207285 | A1 | 9/2006 | Oshitani et al. |
| 2006/0218964 | A1 | 10/2006 | Saito et al. |
| 2007/0007879 | A1 | 1/2007 | Bergman, Jr. et al. |
| 2008/0092559 | A1 | 4/2008 | Williams et al. |
| 2008/0148754 | A1 | 6/2008 | Snytsar |
| 2009/0158727 | A1 | 6/2009 | Marsala |
| 2009/0211298 | A1 | 8/2009 | Saul |
| 2009/0219960 | A1 | 9/2009 | Uberna et al. |
| 2009/0228152 | A1 | 9/2009 | Anderson et al. |
| 2010/0098525 | A1 | 4/2010 | Guelich |
| 2010/0154395 | A1 | 6/2010 | Frick |
| 2011/0114284 | A1 | 5/2011 | Siegenthaler |
| 2012/0167601 | A1 | 7/2012 | Cogswell et al. |
| 2012/0204583 | A1 | 8/2012 | Liu |
| 2012/0312379 | A1 | 12/2012 | Gielda et al. |
| 2013/0000341 | A1 | 1/2013 | Piero et al. |
| 2013/0025305 | A1 | 1/2013 | Higashiiue et al. |
| 2013/0104593 | A1 | 5/2013 | Occhipinti |
| 2013/0111934 | A1 | 5/2013 | Wang et al. |
| 2013/0125569 | A1 | 5/2013 | Verma et al. |
| 2013/0340622 | A1 | 12/2013 | Marty et al. |
| 2014/0075984 | A1 | 3/2014 | Sugawara et al. |
| 2014/0165633 | A1 | 6/2014 | Piero et al. |
| 2014/0166238 | A1 | 6/2014 | Sandu |
| 2014/0260341 | A1 | 9/2014 | Vaisman et al. |
| 2014/0331699 | A1 | 11/2014 | Higashiiue |
| 2014/0345318 | A1 | 11/2014 | Nagano et al. |
| 2014/0366563 | A1 | 12/2014 | Vaisman et al. |
| 2015/0059379 | A1 | 3/2015 | Ootani et al. |
| 2015/0260435 | A1 | 9/2015 | Kawano et al. |
| 2015/0263477 | A1 | 9/2015 | Onaka |
| 2015/0362230 | A1 * | 12/2015 | Al-Farayedhi ..... F24F 1/42 62/291 |
| 2016/0010907 | A1 | 1/2016 | Ali |
| 2016/0114260 | A1 | 4/2016 | Frick |
| 2016/0201956 | A1 | 7/2016 | Tamura et al. |
| 2016/0216029 | A1 | 7/2016 | Ragot |
| 2016/0291137 | A1 | 10/2016 | Sakimura et al. |
| 2016/0333747 | A1 | 11/2016 | KanFman |
| 2017/0081982 | A1 | 3/2017 | Kollmeier et al. |
| 2017/0108263 | A1 | 4/2017 | Cermak et al. |
| 2017/0167767 | A1 | 6/2017 | Shi et al. |
| 2017/0205120 | A1 | 7/2017 | Ali et al. |
| 2017/0299229 | A1 | 10/2017 | Carter et al. |
| 2018/0023805 | A1 | 1/2018 | Qin et al. |
| 2018/0180307 | A1 | 6/2018 | Owejan et al. |
| 2018/0245740 | A1 | 8/2018 | Kaminsky et al. |
| 2018/0245835 | A1 | 8/2018 | Kamei et al. |
| 2018/0328638 | A1 | 11/2018 | Mahmoud et al. |
| 2019/0111764 | A1 | 4/2019 | Oshitani et al. |
| 2019/0170425 | A1 | 6/2019 | Takami et al. |
| 2019/0203988 | A1 | 7/2019 | Kobayashi et al. |
| 2019/0248450 | A1 | 8/2019 | Lee et al. |
| 2019/0293302 | A1 | 9/2019 | Van et al. |
| 2019/0393525 | A1 | 12/2019 | Diethelm et al. |
| 2020/0158386 | A1 | 5/2020 | Wu et al. |
| 2020/0239109 | A1 | 7/2020 | Lee et al. |
| 2020/0363101 | A1 | 11/2020 | Jansen et al. |

OTHER PUBLICATIONS

U.S. Appl. No. 16/666,865, filed Oct. 29, 2019, Davis et al.
U.S. Appl. No. 16/666,881, filed Oct. 29, 2019, Davis et al.
U.S. Appl. No. 16/666,899, filed, Oct. 29, 2019, Davis et al.
U.S. Appl. No. 16/666,940 filed Oct. 29, 2019, Vaisman et al.
U.S. Appl. No. 16/666,950, filed Oct. 29, 2019, Vaisman et al.
U.S. Appl. No. 16/666,954, filed Oct. 29, 2019, Vaisman et al.
U.S. Appl. No. 16/666,959, filed Oct. 29, 2019, Vaisman et al.
U.S. Appl. No. 16/666,962, filed Oct. 29, 2019, Vaisman et al.
U.S. Appl. No. 16/666,966, filed Oct. 29, 2019, Vaisman et al.
U.S. Appl. No. 16/666,973, filed Oct. 29, 2019, Vaisman et al.
U.S. Appl. No. 16/666,977, filed Oct. 29, 2019, Vaisman et al.
U.S. Appl. No. 16/666,986, filed Oct. 29, 2019, Vaisman et al.
U.S. Appl. No. 16/666,992, filed Oct. 29, 2019, Vaisman et al.
U.S. Appl. No. 16/666,995, filed Oct. 29, 2019, Vaisman et al.
U.S. Appl. No. 16/684,775, filed Nov. 15, 2019, Peters et al.
U.S. Appl. No. 16/807,340, filed Mar. 3, 2020, Vaisman.
U.S. Appl. No. 16/807,353, filed Mar. 3, 2020, Vaisman.
U.S. Appl. No. 16/807,411, filed Mar. 3, 2020, Vaisman.
U.S. Appl. No. 16/807,413, filed Mar. 3, 2020, Vaisman.
U.S. Appl. No. 16/807,582, filed Mar. 3, 2020, Vaisman.
[No Author Listed], "Thermostatic Expansion Valves" Theory of Operation, Application, and Selection, Bulletin 10-9, Sporlan, Mar. 2011, 19 pages.
ammonia21.com [online], "R717 vs r404a do the advantages outweigh the disadvantages," Nov. 30, 2012, retrieved from <http://www.annnnonia21.conn/articles/3717/>, 13 pages.
Elstroem, "Capacitive Sensors Measuring the Vapor Quality, Phase of the refrigerant and Ice thickness for Optimized evaporator performance," Proceedings of the 13th IIR Gustav Lorentzen Conference on Natural Refrigerants (GL:2018), Valencia, Spain, Jun. 18-20, 2018, 10 pages.
Elstroem, "New Refrigerant Quality Measurement and Demand Defrost Methods," 2017 IIAR Natural Refrigeration Conference & Heavy Equipment Expo, San Antonio, TX, Technical Paper #1, 38 pages.
en.wikipedia.org [online] "Inert gas—Wikipedia" retrieved on Oct. 1, 2021, retrieved from URL <https://en.wikipedia.org/w/index.php?title=Inert_gas&oldid=1047231716>, 4 pages.
en.wikipedia.org [online] "Pressure regulator—Wikipedia," retrieved on Oct. 7, 2021, retrieved from URL < https://en.wikipedia.org/wiki/Pressure_regulator>, 8 pages.
en.wikipedia.org [online], "Isenthalpic process—Wikipedia, the free encyclopedia," available on or before Mar. 29, 2015, via Internet Archive: Wayback Machine URL <https://web.archive.org/web/20150329105343/https://en.wikipedia.org/wiki/Isenthalpicprocess>, retrieved on Jan. 12, 2021, retrieved from URL <https://en.wikipedia.org/wiki/Isenthalpicprocess>, 2 pages.

(56) References Cited

OTHER PUBLICATIONS en.wikipedia.org [online], "Thermal expansion valve—Wikipedia", Dec. 23, 2020, retrieved on Jan. 8, 2021, retrieved from URL <https://en.wikipedia.org/wiki/Thernnal expansion valve>, 4 pages.
en.wikipedia.org [online], "Thermal expansion valve—Wikipedia," available on or before Feb. 14, 2015, via Internet Archive: Wayback Machine URL <https://web.archive.org/web/20150214054154/https://en.wikipedia.org.wiki/Thermal_expansion_valve>, retrieved on Jan. 12, 2021, URL <https://en.wikipedia.org.wiki/Thermal_expansion_valve>, 3 pages.
engineersedge.com [online], "Throttling Process Thermodynamic," Apr. 16, 2015, via Internet Archive: Wayback Machine URL <https://web.archive.org/web/20150416181050/https://www.engineersedge.conn/thernnodynannics/throttling process.htm>, retrieved on Jan. 12, 2021, retrieved from URL <https://en.wikipedia.org/wiki/lsenthalpicprocess>, 1 pages.
International Search Report and Written Opinion in International Appln. No. PCT/US2020/056787, dated Jan. 27, 2021, 13 pages.
Ohio.edu [online], "20 Engineering Thermodynamics Israel Urieli", Sep. 9, 2009, retrieved from URL< https://www.ohio.edu/mechanical/thermo/Intro/Chapt.1_6/Chapter2a.html>, 1 page.
osha.gov, [online] "Storage and handling of anhydrous ammonia," Part No. 1910, Standard No. 1910.111, GPO Source: e-CFR, 2005, retrieved on Oct. 2, 2021, retrieved from URL <https://www.osha.gov/laws-regs/regulations/standardnumber/1910/1910.111 >, 31 pages.
thermal-engineering.org [online] "What is Vapor Quality—Dryness Fraction—Definition," May 22, 2019, retrieved on Oct. 19, 2021, retrieved from URL < https://www.thermal-engineering.org/what-is-vapor-quality-dryness-fraction-definition/>, 6 pages.
Wojtan et al., "Investigation of flow boiling in horizontal tubes: Part I—A new diabatic two-phase flow pattern map. International journal of heat and mass transfer," Jul. 2005, 48(14):2955-69.
Wojtan et al., "Investigation of flow boiling in horizontal tubes: Part II—Development of a new heat transfer model for stratified-wavy, dryout and mist flow regimes," International journal of heat and mass transfer, Jul. 2005, 48(14):2970-85.
U.S. Appl. No. 16/448,271, filed Jun. 21, 2019, entitled "Thermal Management Systems."
U.S. Appl. No. 16/448,283, filed Jun. 21, 2019, entitled "Thermal Management Systems."
U.S. Appl. No. 16/448,332, filed Jun. 21, 2019, entitled "Thermal Management Systems."
U.S. Appl. No. 16/448,388, filed Jun. 21, 2019, entitled "Thermal Management Systems."
U.S. Appl. No. 16/448,196, filed Jun. 21, 2019, entitled "Thermal Management Systems."
U.S. Appl. No. 16/872,584, filed May 12, 2020, Vaisman et al.
U.S. Appl. No. 16/872,590, filed May 12, 2020, Vaisman et al.
U.S. Appl. No. 16/872,592, filed May 12, 2020, Vaisman et al.
NASA History Office, "Quest for Performance: The Evolution of Modern Aircraft, Part II: The Jet Age, Chapter 10: Technology of the Jet Airplane, Turbojet and Turbofan Systems," NASA Scientific and Technical Information Branch, originally published in 1985, last updated Aug. 6, 2004, 21 pages.

* cited by examiner

THERMAL MANAGEMENT SYSTEMS FOR EXTENDED OPERATION

CLAIM OF PRIORITY

This application claims priority under 35 USC § 119(e) to U.S. Provisional Patent Application Ser. No. 62/754,084, filed on Nov. 1, 2018, and entitled "THERMAL MANAGEMENT SYSTEMS FOR EXTENDED OPERATION," the entire contents of which are hereby incorporated by reference.

BACKGROUND

Refrigeration systems absorb thermal energy from the heat sources operating at temperatures below the temperature of the surrounding environment, and discharge thermal energy into the surrounding environment. Conventional refrigeration systems can include at least a compressor, a heat rejection exchanger (i.e., a condenser), a liquid refrigerant receiver, an expansion device, and a heat absorption exchanger (i.e., an evaporator). Such systems can be used to maintain operating temperature set points for a wide variety of cooled heat sources (loads, processes, equipment, systems) thermally interacting with the evaporator. Closed-circuit refrigeration systems may pump significant amounts of absorbed thermal energy from heat sources into the surrounding environment. Condensers and compressors can be heavy and can consume relatively large amounts of power. In general, the larger the amount of absorbed thermal energy that the system is designed to handle, the heavier the refrigeration system and the larger the amount of power consumed during operation, even when cooling of a heat source occurs over relatively short time periods.

SUMMARY

This disclosure features thermal management systems that can include open circuit refrigeration systems (OCRSs). Open circuit refrigeration systems generally include a liquid refrigerant receiver, an expansion device, and a heat absorption exchanger (i.e., an evaporator). The receiver stores liquid refrigerant which is used to cool heat loads. Typically, the longer the desired period of operation of an open circuit refrigeration system, the larger the receiver and the charge of refrigerant fluid contained within it. OCRSs are useful in many circumstances, including in systems where dimensional and/or weight constraints are such that heavy compressors and condensers typical of closed circuit refrigeration systems are impractical, and/or power constraints make driving the components of closed circuit refrigeration systems infeasible.

According to an aspect, a thermal management system includes an open circuit refrigeration system that has a refrigerant fluid flow path, with the refrigerant fluid flow path including a first receiver configured to store a gas, a second receiver configured to store a liquid refrigerant fluid, with the second receiver coupled to the first receiver, an evaporator coupled to the second receiver, the evaporator configured to extract heat from a heat load that contacts the evaporator, and an exhaust line.

Aspects also include methods and computer program products to control thermal management system with an open circuit refrigerant system.

One or more of the above aspects may include amongst features described herein one or more of the following features.

The system includes a first control device configurable to control a vapor quality of the refrigerant fluid at an outlet of the evaporator. The system includes a second control device configurable to control a temperature of the heat load. The system includes a third control device that is configurable to control a flow of the gas from the first receiver to the second receiver to regulate a vapor pressure in the second receiver. The third control device is configurable to maintain a target vapor pressure in the second receiver during operation of the system. The system includes a flow control device positioned between the first receiver and the second receiver, and configurable to prevent flow of the liquid refrigerant fluid from the second receiver to the first receiver.

The first control device is configurable to receive liquid refrigerant fluid from the second receiver at a first pressure, expand the liquid refrigerant fluid to generate a refrigerant fluid mixture at a second pressure that includes liquid refrigerant fluid and refrigerant fluid vapor, and direct the refrigerant fluid mixture into the evaporator. The first control device includes an expansion valve. The first control device is configured to perform a constant-enthalpy expansion of the liquid refrigerant fluid to generate the refrigerant fluid mixture.

The liquid refrigerant fluid includes ammonia. The gas does not react chemically with the refrigerant fluid. The gas includes at least one gas selected from the group consisting of nitrogen, argon, xenon, and helium.

The second control device is connected downstream from the evaporator along the refrigerant fluid flow path. The second control device includes a back pressure regulator. The back pressure regulator is configured to receive refrigerant fluid vapor generated in the evaporator and to regulate a pressure of the refrigerant fluid upstream from the back pressure regulator along the refrigerant fluid flow path. The back pressure regulator is further configured to perform an expansion of the refrigerant fluid vapor.

The system further includes a first measurement apparatus configured to adjust the first control device based on a first thermodynamic attribute of the system, and a second measurement apparatus configured to adjust the second control device based on a second, different thermodynamic attribute of the system. The first measurement apparatus includes a member connected between the first control device and a first location along the refrigerant fluid flow path and configured to mechanically adjust the first control device, and the first control device includes a first actuation assembly that is adjustable by the member. The first measurement apparatus includes a pressure-sensing bulb connected to the member and configured to move the member in response to a change in a pressure of the refrigerant fluid.

The second measurement apparatus includes a fluid conduit connected between the second control device and a second location along the refrigerant fluid flow path and configured to transport refrigerant fluid from the second location to the second control device to adjust the second control device, and wherein the second control device includes a second actuation assembly that is adjustable by the transported refrigerant fluid. The second actuation assembly is adjustable based on a pressure of the refrigerant fluid transported by the second conduit. The first measurement apparatus includes one or more refrigerant fluid pressure sensors that are configured to generate one or more electrical signals corresponding to a pressure of refrigerant fluid in contact with the one or more refrigerant fluid pressure sensors, and the first control device includes an actuation assembly that is adjustable based on the one or more electrical signals generated by the one or more refrigerant fluid pressure sensors.

The one or more refrigerant fluid pressure sensors are positioned to measure refrigerant fluid pressure at one or more locations in the system and to generate the one or more electrical signals that represent one or more of a refrigerant fluid pressure adjacent to an outlet of the evaporator, a refrigerant fluid pressure adjacent to an outlet of the first control device, a refrigerant fluid pressure difference across the first control device, and a refrigerant fluid pressure difference across the evaporator. The second measurement apparatus includes one or more refrigerant fluid pressure sensors that are configured to generate one or more electrical signals corresponding to a pressure of refrigerant fluid in contact with the one or more sensors, and the second control device includes an actuation assembly that is adjustable based on the one or more electrical signals generated by the one or more refrigerant fluid pressure sensors. The one or more refrigerant fluid pressure sensors are positioned to measure refrigerant fluid pressure at one or more locations in the system and to generate the one or more electrical signals that represent one or more of a refrigerant fluid pressure adjacent to an outlet of the evaporator, a refrigerant fluid pressure adjacent to an outlet of the second control device, a refrigerant fluid pressure difference across the second control device, and a refrigerant fluid pressure difference across the evaporator.

One or more of the above aspects may include one or more of the following advantages/operational features.

The open circuit refrigeration systems disclosed herein can use a mixture of two different phases (e.g., liquid and vapor) of a refrigerant fluid to extract heat energy from a heat load. In particular, for high heat flux loads that are to be maintained within a relatively narrow range of temperatures, heat energy absorbed from the high heat flux load can be used to drive a liquid-to-vapor phase transition in the refrigerant fluid, which occurs at a constant temperature. As a result, the temperature of the high heat flux load can be stabilized to within a relatively narrow range of temperatures. Such temperature stabilization can be particularly important for heat-sensitive high flux loads such as electronic components and devices, which can be easily damaged via excess heating. Refrigerant fluid emerging from the evaporator can be used for cooling of secondary heat loads that do not require temperature regulation to within such a narrow temperature range.

Exhaust refrigerant can be used in the systems disclosed herein in various ways. It can be discharged into ambient environment if there is no prohibitive regulation. Alternatively, depending upon the nature of the refrigerant fluid, exhaust vapor can be incinerated in a combustion unit and used to perform mechanical work. As another example, the vapor can be scrubbed or otherwise chemically treated.

The open circuit refrigeration systems disclosed herein may have other important advantages. For example, relative to closed-circuit systems, the absence of compressors and condensers can result in a significant reduction in the overall size, mass, and power consumption of such systems, relative to conventional closed-circuit systems, particularly when the open circuit refrigeration systems are sized for operation over relatively short time period.

The benefit of maintaining the refrigerant fluid within a two-phase (liquid and vapor) region of the refrigerant fluid's phase diagram, is that the heat extracted from high heat flux loads can be used to drive a constant-temperature liquid to vapor phase transition of the refrigerant fluid, allowing the refrigerant fluid to absorb heat from a high heat flux load without undergoing a significant temperature change. Consequently, the temperature of a high heat flux load can be stabilized within a range of temperatures that is relatively small, even though the amount of heat generated by the load and absorbed by the refrigerant fluid is relatively large.

The details of one or more embodiments are set forth in the accompanying drawings and the description below. Other features and advantages will be apparent from the description, drawings, and claims.

DETAILED DESCRIPTION

I. General Introduction

Figure 1:
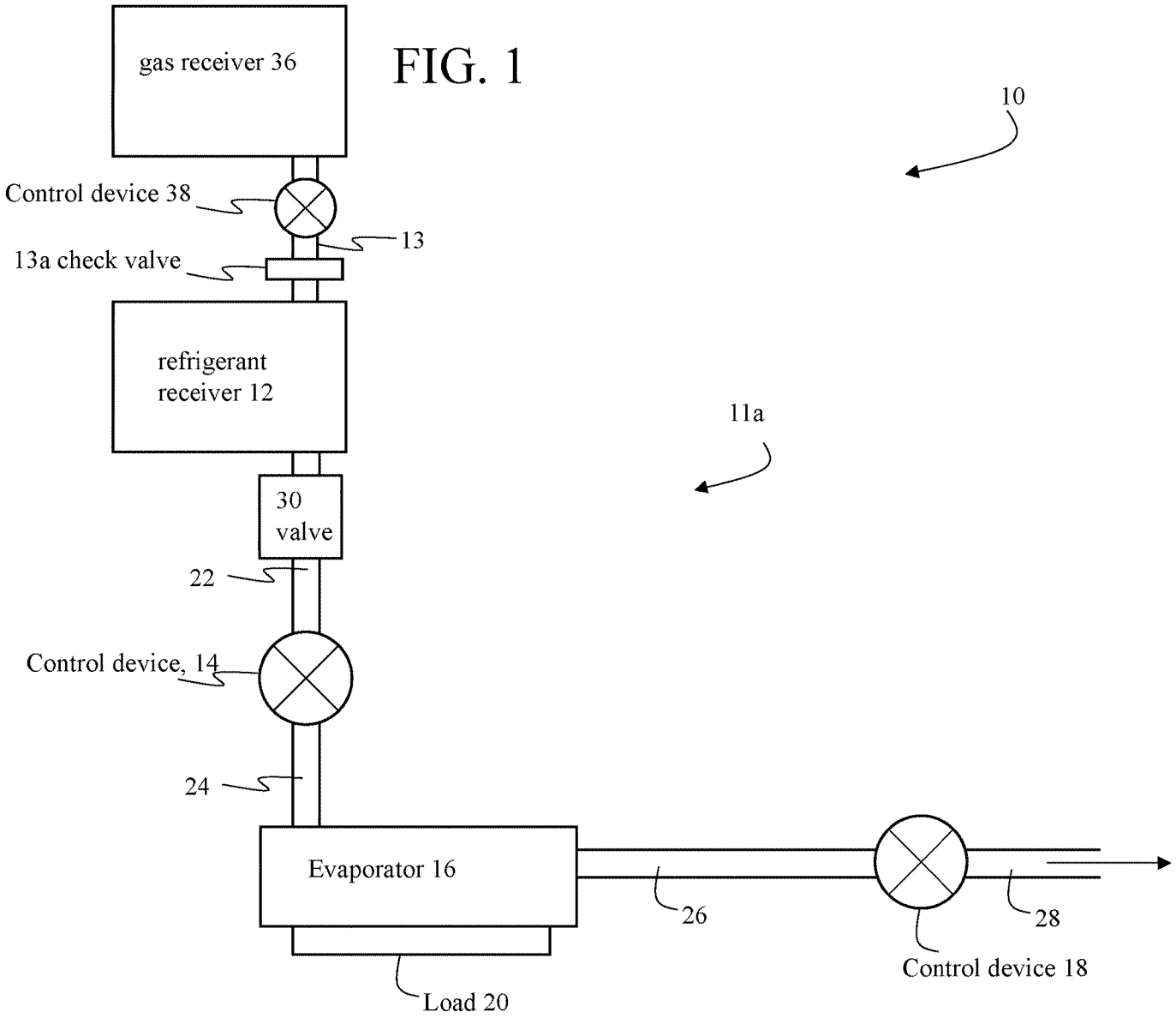
FIG. 1 is a schematic diagram of an example of a thermal management system that includes an open circuit refrigeration system.

Cooling of high heat flux loads that are also highly temperature sensitive can present a number of challenges. On one hand, such loads generate significant quantities of heat that is extracted during cooling. In conventional closed-cycle refrigeration systems, cooling high heat flux loads typically involves circulating refrigerant fluid at a relatively high mass flow rate. However, closed-cycle system components that are used for refrigerant fluid circulation—including compressors and condensers—are typically heavy and consume significant power. As a result, many closed-cycle systems are not well suited for deployment in mobile platforms—such as on small vehicles—where size and weight constraints may make the use of large compressors and condensers impractical.

On the other hand, temperature sensitive loads such as electronic components and devices may require temperature regulation within a relatively narrow range of operating temperatures. Maintaining the temperature of such a load to within a small tolerance of a temperature set point can be challenging when a single-phase refrigerant fluid is used for heat extraction, since the refrigerant fluid itself will increase in temperature as heat is absorbed from the load.

Directed energy systems that are mounted to mobile vehicles such as trucks may present many of the foregoing operating challenges, as such systems may include high heat flux, temperature sensitive components that require precise cooling during operation in a relatively short time. The thermal management systems disclosed herein, while generally applicable to the cooling of a wide variety of thermal loads, are particularly well suited for operation with such directed energy systems.

In particular, the thermal management systems and methods disclosed herein include a number of features that reduce both overall size and weight relative to conventional refrigeration systems, and still extract excess heat energy from both high heat flux, highly temperature sensitive components and relatively temperature insensitive components, to accurately match temperature set points for the components. At the same time the disclosed thermal management systems require no significant power to sustain their operation. Whereas certain conventional refrigeration systems used closed-circuit refrigerant flow paths, the systems and methods disclosed herein use open-cycle refrigerant flow paths. Depending upon the nature of the refrigerant fluid, exhaust refrigerant fluid may be incinerated as fuel, chemically treated, and/or simply discharged at the end of the flow path.

In the thermal management systems disclosed herein, a refrigerant receiver is initially charged with a refrigerant fluid that is in a liquid state. During operation of the system, the refrigerant fluid is transported from the refrigerant receiver through an open-cycle refrigerant flow path, and then discharged from an exhaust line. Effectively, the pressure of the refrigerant fluid in the refrigerant receiver functions as the driving force for mass transport of the refrigerant fluid through the system, as the system does not use a pump or other mechanical device to drive refrigerant fluid flow.

Typically, at the beginning of system operation, the refrigerant pressure in the refrigerant receiver is sufficient to drive refrigerant fluid at a mass flow rate sufficient to provide adequate cooling capacity for one or more loads connected to the system. As operation continues, however, the refrigerant pressure in the refrigerant receiver falls, owing to the continued transport of refrigerant fluid out of the refrigerant receiver. Consequently, the maximum mass flow rate of refrigerant fluid that can be achieved falls. If operation continues for a sufficiently long period of time, the refrigerant pressure in the refrigerant receiver may no longer be adequate to support a desired cooling capacity for the connected loads, even if some refrigerant fluid remains in the refrigerant receiver.

Moreover, the refrigerant pressure in the refrigerant receiver varies according to temperature. When the temperature of the environment within which the system is operated is relatively lower (such that the refrigerant fluid within the refrigerant receiver is also relatively lower), the refrigerant pressure in the refrigerant receiver is also lower, and as a result, the refrigerant fluid in the refrigerant receiver supports a relatively lower maximum mass flow rate of refrigerant fluid through the system. Even at the beginning of system operation, if the refrigerant fluid in the refrigerant receiver is at low enough temperature, the refrigerant pressure may be inadequate to support a refrigerant fluid mass flow rate that achieves a particular necessary or desirable cooling capacity for one or more thermal loads connected to the system.

Typically, as the refrigerant pressure in the refrigerant receiver falls during operation of the system, a relatively complex series of control actions involving at least two control devices is implemented on an ongoing basis to ensure that the system continues to provide adequate cooling capacity for one or more connected thermal loads. These control actions can involve, for example, adjusting the vapor quality of the refrigerant fluid and the temperature of one or more of the thermal loads. To maintain these parameter values within a desired range even as the refrigerant pressure in the refrigerant receiver changes, the control devices can dynamically adjust refrigerant fluid flow rates in different system components.

To ensure that the systems disclosed herein can provide adequate cooling capacity even during start-up at relatively low temperatures, and to reduce the amount of unused refrigerant fluid that remains in the refrigerant receiver when operation of the systems extends to completion, the systems disclosed herein can optionally include one or more gas receivers that are charged with one or more inert gases. The gas receiver(s) is/are connected to the refrigerant receiver, and gas from the gas receiver(s) is transported into the refrigerant receiver to increase the total pressure in the refrigerant receiver. Because the total pressure effectively functions as the driving force for refrigerant fluid transport through the system, the use of one or more gas receivers can extend the operating time of the systems disclosed herein.

In addition, by maintaining a total pressure within the refrigerant receiver that is adequate to drive refrigerant fluid through the systems at a sufficient rate for a longer time, utilization of the refrigerant fluid within the refrigerant receiver increases, and the amount of refrigerant fluid that remains within the refrigerant receiver when operation of the system is fully extended is reduced.

Further, by using gas from the one or more gas receivers to control (e.g., maintain) the total pressure within the refrigerant receiver, the systems can be operated under lower temperature conditions than might otherwise be possible without supplying gas from the one or more gas receivers, and even at start-up under relatively cold environmental conditions, the systems can still provide cooling capacity adequate to support one or more connected thermal loads.

Further still, by using gas from the one or more gas receivers to maintain the total pressure within the refrigerant receiver even as refrigerant fluid is transported out of the refrigerant receiver, the complex control functions implemented in similar systems without gas receivers can be greatly simplified, as the relatively constant pressure within the refrigerant receiver drives a relatively stable mass flow rate of the refrigerant fluid through the system for a comparatively longer time.

II. Thermal Management Systems with Open Circuit Refrigeration Systems

FIG. 1 is a schematic diagram of an example of a thermal management system 10 that includes an open circuit refrigeration system (OCRS) 11*a*. The OCRS 11*a* of system 10 includes a refrigerant receiver 12, an optional valve 30, a first control device 14, an evaporator 16, a second control device 18, and conduits 22, 24, 26, and 28. A thermal load 20 is coupled to evaporator 16. OCRS 11*a* also includes a gas receiver 36 connected to refrigerant receiver 12 via conduit 13, such that a gas flow path extends between gas receiver 36 and refrigerant receiver 12. An optional third control device 38 is positioned along the gas flow path between gas receiver 36 and refrigerant receiver 12. Refrigerant receiver 12 is typically implemented as an insulated vessel that stores a refrigerant fluid at relatively high pressure.

Figure 2:
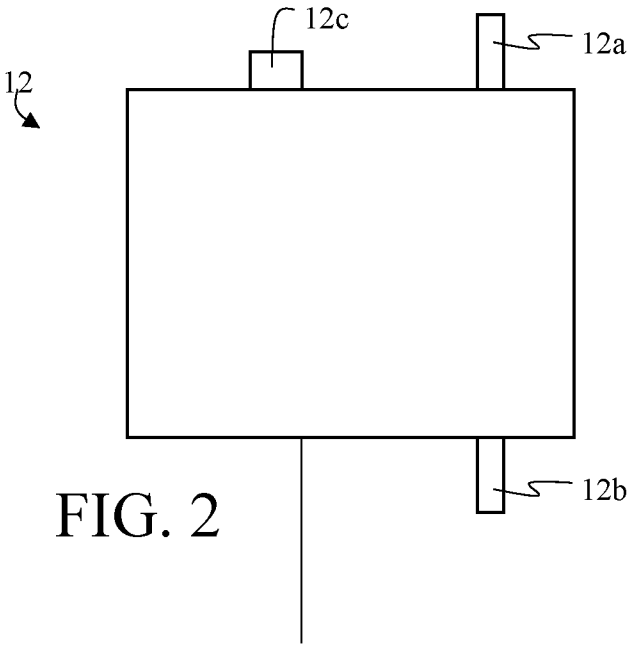
FIG. 2 is a schematic diagram of an example of a receiver for refrigerant fluid in a thermal management system.

FIG. 2 shows a schematic diagram of an example of a refrigerant receiver 12. Refrigerant receiver 12 includes an inlet port 12*a*, an outlet port 12*b*, and a pressure relief valve 12*c*. To charge refrigerant receiver 12, refrigerant fluid is typically introduced into refrigerant receiver 12 via inlet port 12*a*, and this can be done, for example, at service locations. Operating in the field the refrigerant exits refrigerant receiver 12 through output port 12*b* which is connected to conduit 22 (FIG. 1). In case of emergency, if the pressure within refrigerant receiver 12 exceeds a pressure limit value, pressure relief valve 12*c* opens to allow a portion of the refrigerant fluid to escape through valve 12*c* to reduce the pressure within refrigerant receiver 12.

As will be discussed in further detail, when ambient temperature is very low and, as a result, pressure in the receiver is low and insufficient to drive refrigerant fluid flow through the system, gas from gas receiver 36 can be directed into refrigerant receiver 12. The gas compresses liquid refrigerant fluid in refrigerant receiver 12, maintaining the liquid refrigerant fluid in a sub-cooled state, even when the ambient temperature and the temperature of the liquid refrigerant fluid are relatively high. Refrigerant receiver 12 can also include insulation (not shown in FIG. 2) applied around the receiver and the heater to reduce thermal losses.

In general, refrigerant receiver 12 can have a variety of different shapes. In some embodiments, for example, the receiver is cylindrical. Examples of other possible shapes include, but are not limited to, rectangular prismatic, cubic, and conical. In certain embodiments, refrigerant receiver 12 can be oriented such that outlet port 12*b* is positioned at the bottom of the receiver. In this manner, the liquid portion of the refrigerant fluid within refrigerant receiver 12 is discharged first through outlet port 12*b*, prior to discharge of gas.

Returning to FIG. 1, first control device 14 functions as a flow control device. In general, first control device 14 can be implemented as any one or more of a variety of different mechanical and/or electronic devices. For example, in some embodiments, first control device 14 can be implemented as a fixed orifice, a capillary tube, and/or a mechanical or electronic expansion valve. In general, fixed orifices and capillary tubes are passive flow restriction elements which do not actively regulate refrigerant fluid flow.

Mechanical expansion valves (usually called thermostatic or thermal expansion valves) are typically flow control devices that enthalpically expand a refrigerant fluid from a first pressure to an evaporating pressure, controlling the superheat at the evaporator exit. Mechanical expansion valves generally include an orifice, a moving seat that changes the cross-sectional area of the orifice and the refrigerant fluid volume and mass flow rates, a diaphragm moving the seat, and a bulb at the evaporator exit. The bulb is charged with a fluid and it hermetically fluidly communicates with a chamber above the diaphragm. The bulb senses the refrigerant fluid temperature at the evaporator exit (or another location) and the pressure of the fluid inside the bulb, transfers the pressure in the bulb through the chamber to the diaphragm, and moves the diaphragm and the seat to close or to open the orifice.

Typical electrical expansion valves include an orifice, a moving seat, a motor or actuator that changes the position of the seat with respect to the orifice, a controller, and pressure and temperature sensors at the evaporator exit. The controller calculates the superheat for the expanded refrigerant fluid based on pressure and temperature measurements at the evaporator exit. If the superheat is above a set-point value, the seat moves to increase the cross-sectional area and the refrigerant fluid volume and mass flow rates to match the superheat set-point value. If the superheat is below the set-point value the seat moves to decrease the cross-sectional area and the refrigerant fluid flow rates.

Examples of suitable commercially available expansion valves that can function as first control device 14 include, but are not limited to, thermostatic expansion valves available from the Sporlan Division of Parker Hannifin Corporation (Washington, Mo.) and from Danfoss (Syddanmark, Denmark).

Evaporator 16 can be implemented in a variety of ways. In general, evaporator 16 functions as a heat exchanger, providing thermal contact between the refrigerant fluid and heat load 20. Typically, evaporator 16 includes one or more flow channels extending internally between an inlet and an outlet of the evaporator, allowing refrigerant fluid to flow through the evaporator and absorb heat from heat load 20.

A variety of different evaporators can be used in OCRS 11*a*. In general, any cold plate may function as the evaporator of the open circuit refrigeration systems disclosed herein. Evaporator 16 can accommodate any refrigerant fluid channels (including mini/micro-channel tubes), blocks of printed circuit heat exchanging structures, or more generally, any heat exchanging structures that are used to transport single-phase or two-phase fluids. The evaporator and/or components thereof, such as fluid transport channels, can be attached to the heat load mechanically, or can be welded, brazed, or bonded to the heat load in any manner.

Figure 3A:
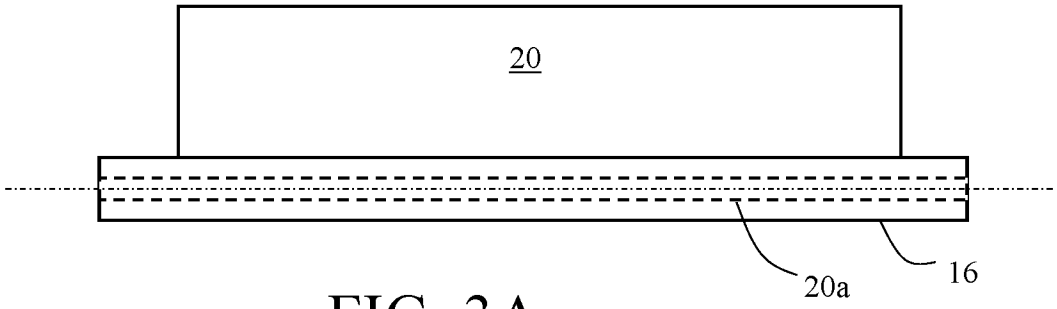
FIGS. 3A and 3B are schematic diagrams showing side and end views, respectively, of an example of a thermal load that includes refrigerant fluid channels.
Figure 3B:
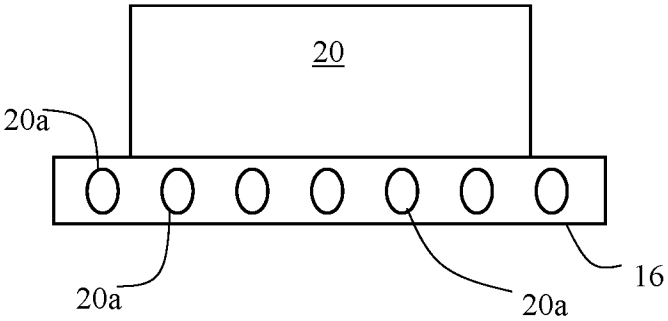

In some embodiments, evaporator 16 (or certain components thereof) can be fabricated as part of heat load 20 or otherwise integrated into heat load 20. FIGS. 3A and 3B show side and end views, respectively, of a heat load 20 with one or more integrated refrigerant fluid channels 20*a*. The portion of head lead 20 with the refrigerant fluid channel(s) 20*a* effectively functions as the evaporator 16 for the system.

Returning to FIG. 1, second control device 18 generally functions to control the fluid pressure upstream of the regulator. In OCRS 11*a*, second control device 18 controls the refrigerant fluid pressure upstream from the evaporator 16 and second control device 18. In general, second control device 18 can be implemented using a variety of different mechanical and electronic devices. Typically, for example, second control device 18 can be implemented as a flow regulation device, such as a back pressure regulator. A back pressure regulator (BPR) is a device that regulates fluid pressure upstream from the regulator.

In general, a wide range of different mechanical and electrical/electronic devices can be used as second control device 18. Typically, mechanical back pressure regulating devices have an orifice and a spring supporting the moving seat against the pressure of the refrigerant fluid stream. The moving seat adjusts the cross-sectional area of the orifice and the refrigerant fluid volume and mass flow rates.

Typical electrical back pressure regulating devices include an orifice, a moving seat, a motor or actuator that changes the position of the seat in respect to the orifice, a controller, and a pressure sensor at the evaporator exit or at the valve inlet. If the refrigerant fluid pressure is above a set-point value, the seat moves to increase the cross-sectional area of the orifice and the refrigerant fluid volume and mass flow rates to re-establish the set-point pressure value. If the refrigerant fluid pressure is below the set-point value, the seat moves to decrease the cross-sectional area and the refrigerant fluid flow rates.

In general, back pressure regulators are selected based on the refrigerant fluid volume flow rate, the pressure differential across the regulator, and the pressure and temperature at the regulator inlet. Examples of suitable commercially available back pressure regulators that can function as second control device 18 include, but are not limited to, valves available from the Sporlan Division of Parker Hannifin Corporation (Washington, Mo.) and from Danfoss (Syddanmark, Denmark).

A variety of different refrigerant fluids can be used in OCRS 11*a*. For open circuit refrigeration systems in general, emissions regulations and operating environments may limit the types of refrigerant fluids that can be used. For example, in certain embodiments, the refrigerant fluid can be ammonia having very large latent heat; after passing through the cooling circuit, the ammonia refrigerant can be disposed of by incineration, by chemical treatment (i.e., neutralization), and/or by direct venting to the atmosphere.

In certain embodiments, the refrigerant fluid can be an ammonia-based mixture that includes ammonia and one or more other substances. For example, mixtures can include one or more additives that facilitate ammonia absorption or ammonia burning.

More generally, any fluid can be used as a refrigerant in the open circuit refrigeration systems disclosed herein, provided that the fluid is suitable for cooling heat load 20 (e.g., the fluid boils at an appropriate temperature) and, in embodiments where the refrigerant fluid is exhausted directly to the environment, regulations and other safety and operating considerations do not inhibit such discharge.

Gas receiver 36 is typically implemented as a vessel (insulated or un-insulated) that stores a gas at relatively high pressure. (See discussion in FIG. 15, below.)

In certain embodiments, there is no third control device 38 positioned between gas receiver 36 and refrigerant receiver 12. With no third control device 38, during operation of OCRS 11*a*, gas in gas receiver 36 is discharged from gas receiver 36 directly into refrigerant receiver 12 through conduit 130.

In some embodiments, with third control device 38 present in OCRS 11*a*, third control device 38 functions to regulate the pressure within refrigerant receiver 12, downstream from third control device 38. During operation of OCRS 11*a*, third control device 38 effectively maintains the total pressure within refrigerant receiver 12 at or above a target pressure value adequate to provide for sub-cooling of refrigerant fluid in refrigerant receiver 12, which maintains a particular refrigerant mass flow rate through first control device 14 and evaporator 16, and as a result, achieves a desired cooling capacity for one or more thermal loads connected to OCRS 11*a*. If the pressure within refrigerant receiver 12 falls below the target pressure value, third control device 38 opens to allow additional gas from gas receiver 36 to enter refrigerant receiver 12, thereby increasing the pressure within refrigerant receiver 12.

If the pressure within refrigerant receiver 12 increases, in certain embodiments, third control device 38 does not perform any action. In some embodiments, however, if the pressure within refrigerant receiver 12 increases beyond an upper limit threshold value, third control device 38 can include a discharge port through which gas (e.g., from refrigerant receiver 12) can be discharged to lower the pressure within refrigerant receiver 12.

Third control device 38, which effectively functions as a flow regulation device for the gas in gas receiver 36, can generally be implemented as any one or more of a variety of different mechanical and/or electronic devices. One example of such a device is a downstream pressure regulator (DPR), which is a device that regulates fluid pressure downstream from the regulator.

In general, a wide range of different mechanical and electrical/electronic devices can be used as third control device 38. Typically, mechanical downstream pressure regulating devices have an orifice and a spring supporting the moving seat against the pressure of the gas in refrigerant receiver 12. The moving seat adjusts the cross-sectional area of the orifice and the gas flow rate from gas receiver 36 to refrigerant receiver 12.

Typical electrical downstream pressure regulating devices include an orifice, a moving seat, a motor or actuator that changes the position of the seat with respect to the orifice, a controller, and a pressure sensor. If the pressure in refrigerant receiver 12 (as measured by the pressure sensor) is below a set-point value, the seat moves to increase the cross-sectional area of the orifice and allow more gas to flow from gas receiver 36 to refrigerant receiver 12.

Examples of suitable commercially available downstream pressure regulators that can function as third control device 38 include, but are not limited to, regulators available from Emerson Electric (St. Louis, Mo.).

In certain embodiments, either with or without third control device 38 present in OCRS 11*a*, OCRS 11*a* can include a check valve 13*a* positioned between gas receiver 36 and refrigerant receiver 12. Check valve 13*a* functions to prevent backflow of gas from refrigerant receiver 12 to gas receiver 36 during operation of OCRS 11*a*.

In some embodiments, refrigerant receiver 12 is positioned inside gas receiver 36. See FIG. 16 below for an example of a refrigerant receiver postponed within a gas receiver.

In certain embodiments, a combined refrigerant and gas receiver is charged with both refrigerant fluid and gas. For example, referring to FIG. 2, receiver 12 can be charged with both refrigerant fluid and gas through inlet 12*a*. Because the refrigerant fluid is entirely in a liquid phase, the refrigerant fluid rests on the bottom of receiver 12, while the gas occupies the portion of the internal volume above the liquid refrigerant fluid. During operation, the refrigerant fluid leaves through outlet 12*b* at the bottom of receiver 12, while the gas remains in receiver 12.

The gas can be introduced from gas receiver 36 into refrigerant receiver 12 in various ways. In some embodiments, for example, the initial charge of gas in gas receiver 36, the configurations of gas receiver 36 and refrigerant receiver 12, and the system operating conditions are selected such that the pressure in refrigerant receiver 12 is always sufficiently high so that the refrigerant fluid in receiver 12 is maintained entirely in a sub-cooled, liquid state. The liquid refrigerant fluid is located at the bottom of refrigerant receiver 12 and is extracted through outlet 12*b*, while the gas delivered from gas receiver 36 into refrigerant receiver 12 remains in the refrigerant receiver and drives the flow of refrigerant fluid through the system.

Alternatively, in certain embodiments, the initial charge of gas in gas receiver 36, the configurations of gas receiver 36 and refrigerant receiver 12, and the system operating conditions are selected such that not all of the liquid refrigerant fluid remains in a liquid state. Instead, a portion of the liquid refrigerant evaporates, and the refrigerant fluid vapor mixes with the gas introduced from gas receiver 36. In this configuration, the total gas pressure above the liquid refrigerant fluid within refrigerant receiver 12 is the sum of the partial pressure of the gas from gas receiver 36 and the partial pressure of the refrigerant fluid vapor. This total gas pressure drives the flow of refrigerant fluid through the system.

A variety of different gases can be introduced into gas receiver 36 to control the gas pressure in refrigerant receiver 12. In general, gases that are used are inert (or relatively inert) with respect to the refrigerant fluid. As an example, when a refrigerant fluid such as ammonia is used, suitable gases that can be introduced into gas receiver 36 include, but are not limited to, one or more of nitrogen, argon, xenon, and helium.

It should be appreciated that while OCRS 11*a* is shown in FIG. 1 and discussed above with respect to a single gas receiver 36, more generally OCRS 11*a* can include any number of gas receivers, along with any number of the other associated components (e.g., control devices, check valves, ports, and sensors) discussed above. For example, OCRS 11*a* can include two or more gas receivers (e.g., three or more gas receivers, four or more gas receivers, five or more gas receivers).

When OCRS 11*a* includes a gas receiver 36, the charging procedure for introducing refrigerant fluid into refrigerant receiver 12 is generally adapted to ensure that refrigerant fluid is not re-directed into gas receiver 36. To introduce the refrigerant fluid into refrigerant receiver 12, a valve positioned in-line on conduit 130 (i.e., control device 38, check valve 13*a*, or another valve such as a solenoid valve or shut-off valve) is first closed to isolate the refrigerant receiver 12 and gas receiver 36. Then, remaining refrigerant fluid and gas within refrigerant receiver 12 are discharged through exhaust line 28. In some embodiments, OCRS 11*a* includes a check valve positioned in-line along exhaust line 28 to ensure that gases such as ambient air do not flow into OCRS 11*a* through exhaust line 28.

Next, a valve positioned downstream from refrigerant receiver 12 (e.g., first control device 14, or another device such as a shut-off valve or solenoid valve) is then closed to isolate refrigerant receiver 12 from downstream components of OCRS 11*a*. Finally, refrigerant fluid is introduced into refrigerant receiver 12 (e.g., through inlet 12*a*).

Other methods can also be used to introduce refrigerant fluid into refrigerant receiver 12. In certain embodiments, for example, to introduce refrigerant fluid into refrigerant receiver, valves upstream and downstream of refrigerant receiver 12 can be closed to isolate the refrigerant receiver from the rest of OCRS 11*a*. The upstream and downstream valves can correspond to any of the devices discussed above in connection with the refrigerant fluid charging methods. Next, remaining refrigerant fluid is discharged from refrigerant receiver 12, e.g., through an outlet located near the top of refrigerant receiver 12. Then, refrigerant fluid is introduced into refrigerant receiver 12 through inlet 12*a*.

Further still, in some embodiments, refrigerant fluid can be introduced into both refrigerant receiver 12 and evaporator 16, by suitably isolating these system components (e.g., by closing valves positioned upstream and/or downstream from refrigerant receiver 12 and/or evaporator 16), discharging remaining refrigerant fluid in the components, and then introducing new refrigerant fluid.

Returning to FIG. 1, during operation of OCRS 11*a*, cooling can be initiated by a variety of different mechanisms. In some embodiments, for example, OCRS 11*a* includes a temperature sensor attached to load 20 (as will be discussed subsequently). When the temperature of load 20 exceeds a certain temperature set point (i.e., threshold value), a controller connected to the temperature sensor can initiate cooling of load 20.

Alternatively, in certain embodiments, OCRS 11*a* operates essentially continuously—provided that the pressure within refrigerant receiver 12 is sufficient—to cool load 20. As soon as refrigerant receiver 12 is charged with refrigerant fluid, refrigerant fluid is ready to be directed into evaporator 16 to cool load 20. In general, cooling is initiated when a user of the system or the heat load issues a cooling demand.

Upon initiation of a cooling operation, refrigerant fluid from refrigerant receiver 12 is discharged from outlet 12*b* and through optional valve 30 if present. As discussed above, the driving force for the transport of refrigerant fluid through OCRS 11*a* is the pressure within refrigerant receiver 12. Refrigerant receiver 12 may initially contain mostly refrigerant fluid, so that the pressure within refrigerant receiver 12 is largely due to the refrigerant fluid. Alternatively, refrigerant receiver 12 may initially contain a mixture of a comparatively smaller quantity of refrigerant fluid vapor and gas introduced from gas receiver 36, and the pressure within refrigerant receiver 12 may include contributions from both the gas and the refrigerant fluid vapor. As another alternative, refrigerant receiver 12 may initially contain refrigerant fluid in a sub-cooled liquid state and a gas different from the refrigerant fluid (e.g., a gas that is relatively inert with respect to the refrigerant fluid), such that the pressure within refrigerant receiver 12 is entirely, or almost entirely, due to the gas.

As refrigerant fluid leaves refrigerant receiver 12, gas is introduced into refrigerant receiver 12 from gas receiver 36. The introduced gas helps to maintain the pressure within refrigerant receiver 12, and therefore the driving force for flow of refrigerant fluid through OCRS 11*a*.

Refrigerant fluid is transported through conduit 22 to first control device 14, which directly or indirectly controls vapor quality at the evaporator outlet. In the following discussion, first control device 14 is implemented as an expansion valve. However, it should be understood that more generally, first control device 14 can be implemented as any component or device that performs the functional steps described below and provides for vapor quality control at the evaporator outlet.

Once inside the expansion valve, the refrigerant fluid undergoes constant enthalpy expansion from an initial pressure $p_r$ (i.e., the receiver pressure) to an evaporation pressure $p_e$ at the outlet of the expansion valve. In general, the evaporation pressure $p_e$ depends on a variety of factors, most notably the desired temperature set point value (i.e., the target temperature) at which load 20 is to be maintained and the heat input generated by the heat load.

The initial pressure in the receiver tends to be in equilibrium with the surrounding temperature and is different for different refrigerant fluids. The pressure in the evaporator depends on the evaporating temperature, which is lower than the heat load temperature and is defined during design of the system. The system is operational as long the receiver-to-evaporator pressure difference is sufficient to drive adequate refrigerant fluid flow through the expansion valve.

After undergoing constant enthalpy expansion in the expansion valve, the liquid refrigerant fluid is converted to a mixture of liquid and vapor phases at the temperature of the fluid and evaporation pressure pc. The two-phase refrigerant fluid mixture is transported via conduit 24 to evaporator 16.

When the two-phase mixture of refrigerant fluid is directed into evaporator 16, the liquid phase absorbs heat from load 20, driving a phase transition of the liquid refrigerant fluid into the vapor phase. Because this phase transition occurs at (nominally) constant temperature, the temperature of the refrigerant fluid mixture within evaporator 16 remains unchanged, provided at least some liquid refrigerant fluid remains in evaporator 16 to absorb heat.

Further, the constant temperature of the refrigerant fluid mixture within evaporator 16 can be controlled by adjusting the pressure pc of the refrigerant fluid, since adjustment of $p_e$ changes the boiling temperature of the refrigerant fluid. Thus, by regulating the refrigerant fluid pressure $p_e$ upstream from evaporator 16 (e.g., using second control device 18), the temperature of the refrigerant fluid within evaporator 16 (and, nominally, the temperature of heat load 20) can be controlled to match a specific temperature set-point value for load 20, ensuring that load 20 is maintained at, or very near, a target temperature.

The pressure drop across the evaporator causes drop of the temperature of the refrigerant mixture (which is the evaporating temperature), but still the evaporator can be configured to maintain the heat load temperature within in the set tolerances.

In some embodiments, for example, the evaporation pressure of the refrigerant fluid can be adjusted by second control device 18 to ensure that the temperature of thermal load 20 is maintained to within ±5 degrees C. (e.g., to within ±4 degrees C., to within ±3 degrees C., to within ±2 degrees C., to within ±1 degree C.) of the temperature set point value for load 20.

As discussed above, within evaporator 16, a portion of the liquid refrigerant in the two-phase refrigerant fluid mixture is converted to refrigerant vapor by undergoing a phase change. As a result, the refrigerant fluid mixture that emerges from evaporator 16 has a higher vapor quality (i.e., the fraction of the vapor phase that exists in refrigerant fluid mixture) than the refrigerant fluid mixture that enters evaporator 16.

As the refrigerant fluid mixture emerges from evaporator 16, a portion of the refrigerant fluid can optionally be used to cool one or more additional thermal loads. Typically, for example, the refrigerant fluid that emerges from evaporator 16 is nearly in the vapor phase. The refrigerant fluid vapor (or, more precisely, high vapor quality fluid vapor) can be directed into a heat exchanger coupled to another thermal load, and can absorb heat from the additional thermal load during propagation through the heat exchanger. Examples of systems in which the refrigerant fluid emerging from evaporator 16 is used to cool additional thermal loads will be discussed in more detail subsequently.

The refrigerant fluid emerging from evaporator 16 is transported through conduit 26 to second control device 18, which directly or indirectly controls the upstream pressure, that is, the evaporating pressure pc in the system. After passing through second control device 18, the refrigerant fluid is discharged as exhaust through conduit 28, which functions as an exhaust line for OCRS 11*a*. Refrigerant fluid discharge can occur directly into the environment surrounding OCRS 11*a*. Alternatively, in some embodiments, the refrigerant fluid can be further processed; various features and aspects of such processing are discussed in further detail below.

It should be noted that the foregoing steps, while discussed sequentially for purposes of clarity, occur simultaneously and continuously during cooling operations. In other words, refrigerant fluid is continuously being discharged from refrigerant receiver 12, undergoing continuous expansion in first control device 14, flowing continuously through evaporator 16 and second control device 18, and being discharged from OCRS 11*a*, while thermal load 20 is being cooled. Similarly, gas can be transported continuously (or nearly continuously, or periodically) from gas receiver 36 to refrigerant receiver 12 to maintain the pressure in refrigerant receiver 12.

As discussed above, during operation of OCRS 11*a*, as refrigerant fluid is drawn from refrigerant receiver 12 and used to cool thermal load 20, the pressure driving the refrigerant fluid in refrigerant receiver 12 through the system can be maintained at a constant value for an extended period of operation by introducing gas from gas receiver 36 into refrigerant receiver 12. In systems where a common receiver is charged with both refrigerant fluid and gas (as described above) or when gas receiver 36 is undercharged initially with gas, the period during which constant pressure can be maintained in refrigerant receiver 12 may be compromised.

If the pressure within refrigerant receiver 12 falls sufficiently, the capacity of OCRS 11*a* to maintain a particular temperature set point value for load 20 may be compromised. Therefore, the pressure in the refrigerant receiver 12, in gas receiver 36, or the pressure drop across the expansion valve (or any related refrigerant fluid pressure or pressure drop in OCRS 11*a*) can be measured and used to adjust operation of the first control device 14.

In addition, one or more measured pressure values can provide an indicator of the remaining operational time. An appropriate warning signal can be issued (e.g., by a system controller) to indicate that in certain period of time, the system may no longer be able to maintain adequate cooling performance; operation of the system can even be halted if the pressure in refrigerant receiver 12 (or any other measured pressure value in OCRS 11*a*) reaches a low-end threshold value.

It should be noted that while in FIG. 1 only a single refrigerant receiver 12 is shown, in some embodiments, OCRS 11*a* can include multiple receivers to allow for operation of the system over an extended time period. Each of the multiple receivers can supply refrigerant fluid to the system to extend to total operating time period. Some embodiments may include plurality of evaporators connected in parallel, which may or may not accompanied by plurality of expansion valves and plurality of evaporators.

III. System Operational Control

As discussed in the previous section, by adjusting the pressure pc of the refrigerant fluid, the temperature at which the liquid refrigerant phase undergoes vaporization within evaporator 16 can be controlled. Thus, in general, the temperature of heat load 20 can be controlled by a device or component of OCRS 11*a* that regulates the pressure of the refrigerant fluid within evaporator 16. Typically, second control device 18 (which can be implemented as a back pressure regulator) adjusts the upstream refrigerant fluid pressure in OCRS 11*a*. Accordingly, second control device 18 is generally configured to control the temperature of heat load 20, and can be adjusted to selectively change a temperature set point value (i.e., a target temperature) for heat load 20.

Another important system operating parameter is the vapor quality of the refrigerant fluid emerging from evaporator 16. The vapor quality, which is a number from 0 to 1, represents the fraction of the refrigerant fluid that is in the vapor phase. Because heat absorbed from load 20 is used to drive evaporation of liquid refrigerant to form refrigerant vapor in evaporator 16, it is generally important to ensure that, for a particular volume of refrigerant fluid propagating through evaporator 16, at least some of the refrigerant fluid remains in liquid form right up to the point at which the exit aperture of evaporator 16 is reached to allow continued heat absorption from load 20 without causing a temperature increase of the refrigerant fluid. If the fluid is fully converted to the vapor phase after propagating only partially through evaporator 16, further heat absorption by the now vapor-phase refrigerant fluid within evaporator 16 will lead to a temperature increase of the refrigerant fluid and heat load 20. Even before all refrigerant fluid is converted to the vapor phase, if the temperature of the refrigerant fluid increases, further heat absorption by the two-phase refrigerant fluid mixture can occur at a vapor quality above the critical vapor quality that drives the evaporation process in a portion of evaporator 16.

On the other hand, liquid-phase refrigerant fluid that emerges from evaporator 16 represents unused heat-absorbing capacity, in that the liquid refrigerant fluid did not absorb sufficient heat from load 20 to undergo a phase change. To ensure that OCRS 11*a* operates efficiently, the amount of unused heat-absorbing capacity should remain relatively small, and should be defined by the critical vapor quality.

In addition, the boiling heat transfer coefficient that characterizes the effectiveness of heat transfer from load 20 to the refrigerant fluid is typically very sensitive to vapor quality. When the vapor quality increases from zero to a certain value, called a critical vapor quality, the heat transfer coefficient increases. When the vapor quality exceeds the critical vapor quality, the heat transfer coefficient is abruptly reduced to a very low value, causing dryout within evaporator 16. In this region of operation, the two-phase mixture behaves as superheated vapor.

In general, the critical vapor quality and heat transfer coefficient values vary widely for different refrigerant fluids, and heat and mass fluxes. For all such refrigerant fluids and operating conditions, the systems and methods disclosed herein control the vapor quality at the outlet of the evaporator such that the vapor quality approaches the threshold of the critical vapor quality.

To make maximum use of the heat-absorbing capacity of the two-phase refrigerant fluid mixture, the vapor quality of the refrigerant fluid emerging from evaporator 16 should nominally be equal to the critical vapor quality. Accordingly, to both efficiently use the heat-absorbing capacity of the two-phase refrigerant fluid mixture and also ensure that the temperature of heat load 20 remains approximately constant at the phase transition temperature of the refrigerant fluid in evaporator 16, the systems and methods disclosed herein are generally configured to adjust the vapor quality of the refrigerant fluid emerging from evaporator 16 to a value that is less than or equal to the critical vapor quality.

Another important operating consideration for OCRS 11*a* is the mass flow rate of refrigerant fluid within the system. Evaporator can be configured to provide minimal mass flow rate controlling maximal vapor quality, which is the critical vapor quality. By minimizing the mass flow rate of the refrigerant fluid according to the cooling requirements for heat load 20, OCRS 11*a* operates efficiently. Each reduction in the mass flow rate of the refrigerant fluid (while maintaining the same temperature set point value for heat load 20) means that the charge of refrigerant fluid added to reservoir 12 initially lasts longer, providing further operating time for OCRS 11*a*.

Within evaporator 16, the vapor quality of a given quantity of refrigerant fluid varies from the evaporator inlet (where vapor quality is lowest) to the evaporator outlet (where vapor quality is highest). Nonetheless, to realize the lowest possible mass flow rate of the refrigerant fluid within the system, the effective vapor quality of the refrigerant fluid within evaporator 16—even when accounting for variations that occur within evaporator 16—should match the critical vapor quality as closely as possible.

In summary, to ensure that the system operates efficiently and the mass flow rate of the refrigerant fluid is relatively low, and at the same time the temperature of heat load 20 is maintained within a relatively small tolerance, OCRS 11*a* adjusts the vapor quality of the refrigerant fluid emerging from evaporator 16 to a value such that an effective vapor quality within evaporator 16 matches, or nearly matches, the critical vapor quality.

In OCRS 11*a*, first control device 14 is generally configured to control the vapor quality of the refrigerant fluid emerging from evaporator 16. As an example, when first control device 14 is implemented as an expansion valve, the expansion valve regulates the mass flow rate of the refrigerant fluid through the valve. In turn, for a given set of operating conditions (e.g., ambient temperature, initial pressure in the receiver, temperature set point value for heat load 20, heat load 20), the vapor quality determines mass flow rate of the refrigerant fluid emerging from evaporator 16.

First control device 14 typically controls the vapor quality of the refrigerant fluid emerging from evaporator 16 in response to information about at least one thermodynamic quantity that is either directly or indirectly related to the vapor quality. Second control device 18 typically adjusts the temperature of heat load 20 (via upstream refrigerant fluid pressure adjustments) in response to information about at least one thermodynamic quantity that is directly or indirectly related to the temperature of heat load 20. The one or more thermodynamic quantities upon which adjustment of first control device 14 is based are different from the one or more thermodynamic quantities upon which adjustment of second control device 18 is based.

In general, a wide variety of different measurement and control strategies can be implemented in OCRS 11*a* to achieve the control objectives discussed above. Generally, first control device 14 is connected to a first measurement device and second control device 18 is connected to a second measurement device. The first and second measurement device provide information about the thermodynamic quantities upon which adjustments of the first and second control device are based. The first and second measurement device can be implemented in many different ways, depending upon the nature of the first and second control device.

Figure 4:
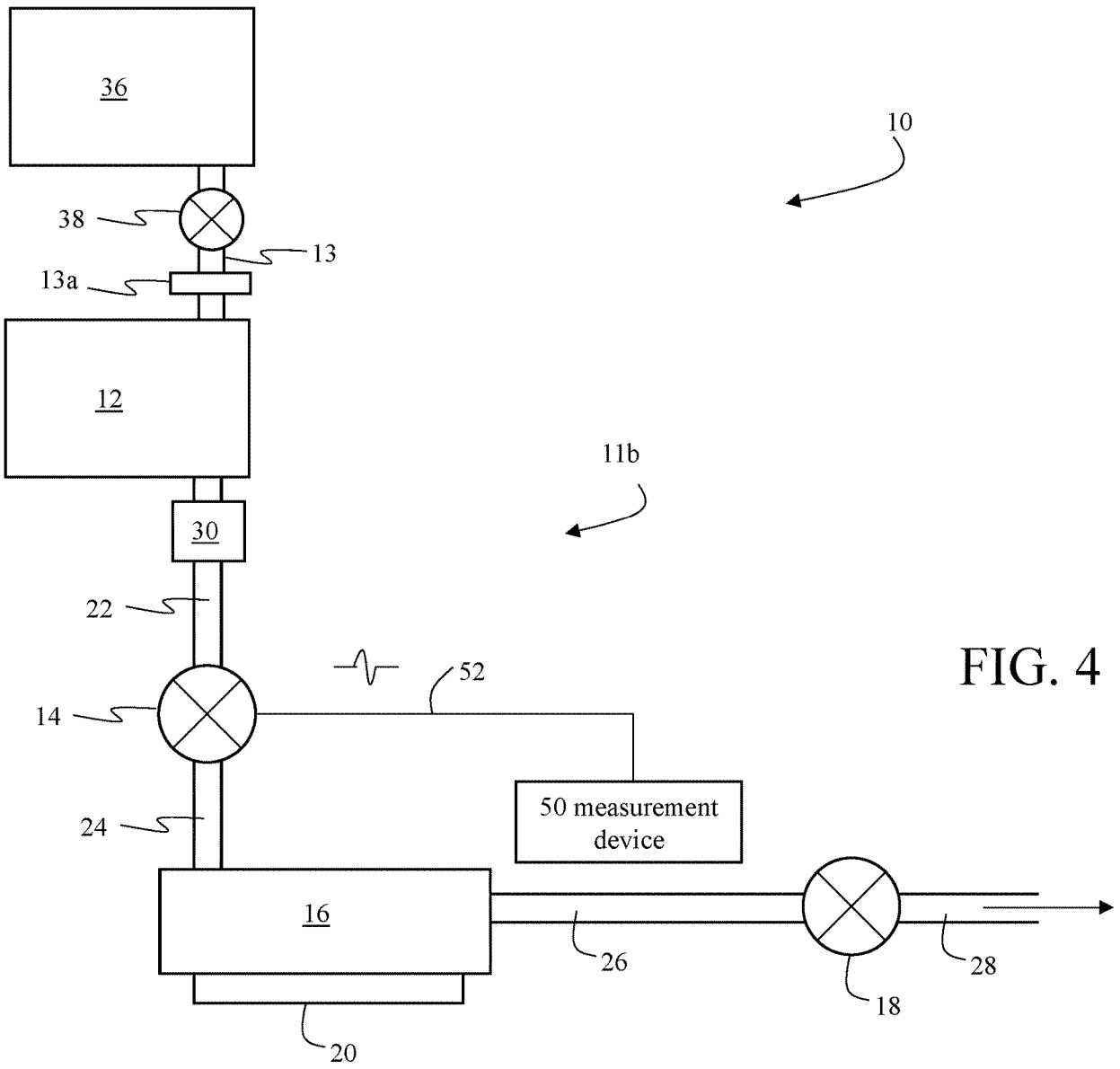
FIG. 4 is a schematic diagram of an example of a thermal management system that optionally includes a mechanically-regulated first control device and optionally includes a mechanically-regulated second control device.

Referring now to FIG. 4, the system 10 is shown with another embodiment of a thermal management OCRS 11*b* that optionally includes a first control device 14 implemented as a mechanical expansion valve. First control device 14 is connected to a first measurement device 50 that is used to convey a signal 52 to an actuation assembly within the mechanical expansion valve 14 to adjust the diameter of the orifice in the mechanical expansion valve. The first measurement device 50 can be implemented in various ways. In some embodiments, for example, first measurement device 50 includes a pressure-sensing bulb connected to a member such as an arm. Typically, the pressure-sensing bulb is positioned after a second heat load (which will be discussed in more detail subsequently) in the system and deforms mechanically in response to changes in in-line pressure of the refrigerant fluid following the second heat load. In this respect, the bulb is responsive to changes in superheat of the refrigerant fluid downstream from the second heat load.

The member, coupled to the pressure-sensing bulb, also moves in response to changes in superheat of the refrigerant fluid. The other end of the mechanical member is typically connected to an actuation assembly in the mechanical expansion valve. The actuation assembly includes, for example, a movable diaphragm that adjusts the orifice diameter within the valve. As the pressure-sensing bulb deforms in response to changes in superheat of the refrigerant fluid downstream from the second heat load, the mechanical deformation is coupled through the member to the diaphragm, which moves in concert to adjust the orifice diameter. In this manner, fully automated, responsive control of the mechanical expansion valve can be achieved based on changes in superheat of the refrigerant fluid.

As shown in FIG. 4, second control device 18 can also be optionally implemented as a mechanical back pressure regulator. In general, mechanical back pressure regulators that are suitable for use in the systems disclosed herein include an inlet, an outlet, and an adjustable internal orifice (not shown in FIG. 4). To regulate the internal orifice, the mechanical back pressure regulator senses the in-line pressure of refrigerant fluid entering through the inlet, and adjusts the size of the orifice accordingly to control the flow of refrigerant fluid through the regulator and thus, to regulate the upstream refrigerant fluid pressure in the system.

Mechanical back pressure regulators suitable for use in the systems disclosed herein can generally have a variety of different configurations. Certain back pressure regulators, for example, have a small diameter passageway or conduit in a housing or body of the regulator that admits a small quantity of refrigerant fluid vapor that exerts pressure on an internal mechanism (for example, a spring-coupled valve stem) to adjust the size of the orifice. Effectively, in the above example, the passageway or conduit functions as a measurement device for the mechanical back pressure regulator, and the spring-coupled valve stem functions as an actuation assembly.

As discussed above in connection with FIG. 1, in certain embodiments of OCRS 11*b*, OCRS 11*b* also includes three control devices: first control device 14, which controls the vapor quality of the refrigerant fluid emerging from evaporator 16; second control device 18, which controls the temperature of heat load 20 (via upstream refrigerant fluid pressure adjustments); and third control device 38, which controls the pressure in refrigerant receiver 12.

Because the temperature of the liquid refrigerant fluid is sensitive to ambient temperature, the density of the liquid refrigerant fluid can change even when the pressure in refrigerant receiver 12 remains approximately the same. Further, the temperature of the liquid refrigerant fluid affects the vapor quality at the inlet of evaporator 16. Therefore, in some embodiments, the refrigerant fluid mass and volume flow rates change, and the systems include three control devices.

However, because third control device 38 effectively functions as a flow control device for refrigerant fluid in OCRS 11*b* (by adjusting the pressure in refrigerant receiver 12, which in turn may control the mass flow rate of refrigerant fluid in OCRS 11*a*) when the temperature of the liquid refrigerant fluid changes by only a relatively small amount or not at all, in some embodiments, OCRS 11*b* includes only second control device 18 and third control device 38. Similarly, in certain embodiments, OCRS 11*b* includes only first control device 14 and third control device 38. That is, OCRS 11*b* includes two, rather than three, active control devices.

For systems that include first control device 14 and third control device 38, third control device 38 can effectively take over the function of second control device 18. That is, while first control device 14 controls the vapor quality of the refrigerant fluid emerging from evaporator 16, third control device 38 controls the temperature of heat load 20 (via indirect control of the mass flow rate of refrigerant fluid in OCRS 11*b*). As discussed above, adjustments made by first control device 14 and third control device 38 are based on different thermodynamic quantities. Such systems typically also include a passive expansion device in place of second control device 18, which performs expansion of refrigerant fluid vapor (e.g., isenthalpic expansion) with no (or very minor) adjustable flow regulation through the passive expansion device.

For systems that include second control device 18 and third control device 38, third control device 38 can effectively take over the function of first control device 14. Thus, while second control device 18 controls the temperature of heat load 20, third control device 38 controls the vapor quality of the refrigerant fluid emerging from evaporator 16 (via indirect control of the mass flow rate of refrigerant fluid in OCRS 11*b*). Adjustments made by second control device 18 and third control device 38 are based on different thermodynamic quantities. Such systems typically also include a passive expansion device in place of first control device 14, which performs expansion of refrigerant fluid (e.g., isenthalpic expansion) to generate a two-phase refrigerant fluid mixture that is transported into evaporator 16, with no (or very minor) adjustable flow regulation through the passive expansion device.

It should generally be understood that various control strategies, control device, and measurement device can be implemented in a variety of combinations in the systems disclosed herein. Thus, for example, one or more of the first, second, and third control devices can be implemented as mechanical devices, as described above. In addition, systems with mixed control devices in which one of the first, second, or third control devices is a mechanical device and one or more of the other control devices is implemented as an electronically-adjustable device can also be implemented, along with systems in which the first, second, and third control devices are electronically-adjustable devices that are controlled in response to signals measured by one or more sensors.

In some embodiments, the systems disclosed herein can include measurement devices featuring one or more system sensors and/or measurement devices that measure various system properties and operating parameters, and transmit electrical signals corresponding to the measured information.

Figure 5:
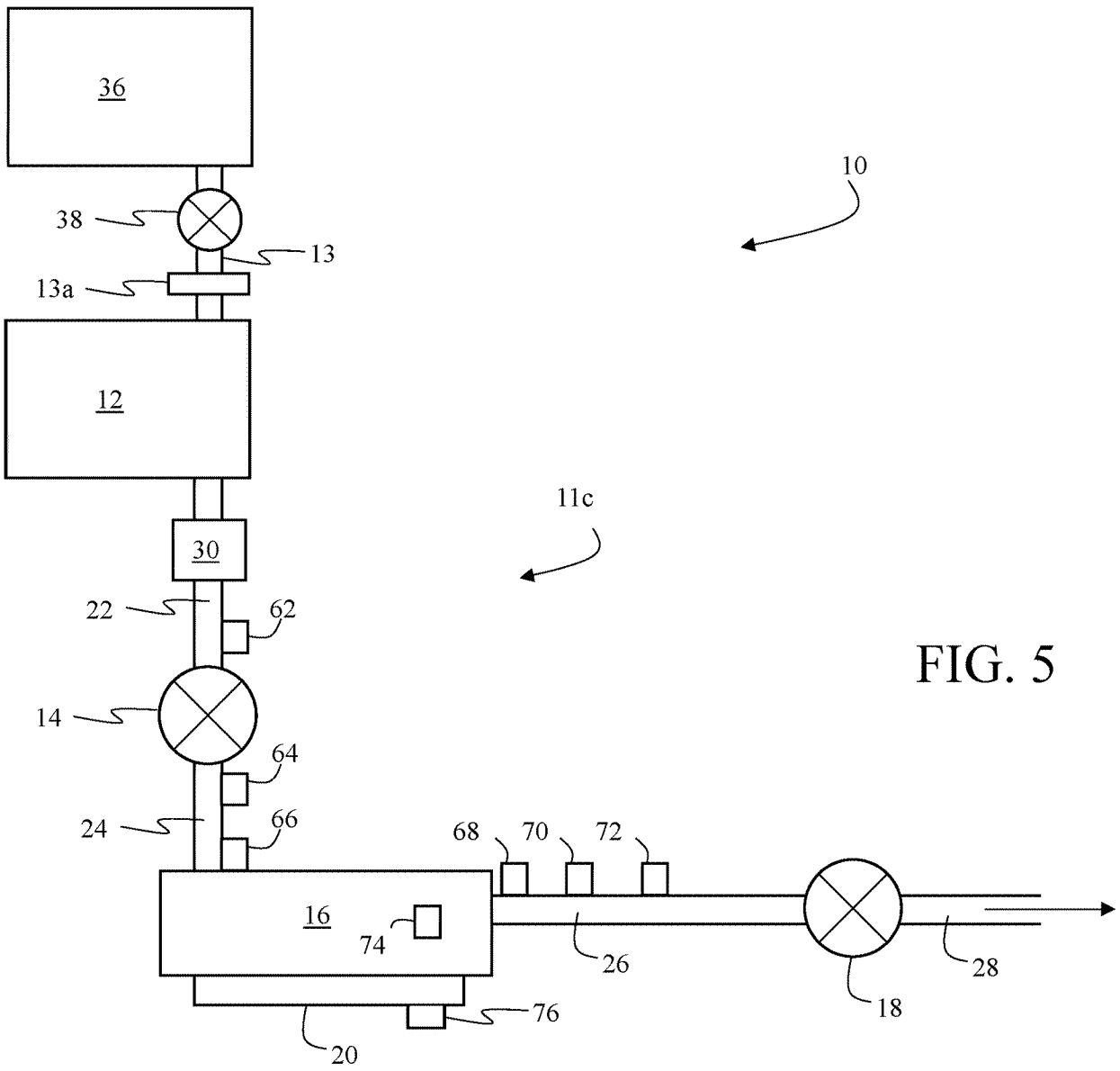
FIG. 5 is a schematic diagram of an example of a thermal management system that includes one or more sensors for measuring system properties.

FIG. 5 shows a thermal management OCRS 11*c* that includes a number of different sensors. Each of the sensors shown in OCRS 11*c* is optional, and various combinations of the sensors shown in OCRS 11*c* can be used to measure signals that are used to adjust first control device 14 and/or second control device 18.

Shown in FIG. 5 are optional pressure sensors 62 and 64 upstream and downstream from first control device 14, respectively. Sensors 62 and 64 are configured to measure information about the pressure differential $p_r - p_e$ across first control device 14, and to transmit an electronic signal corresponding to the measured pressure difference information. Sensor 62 effectively measures $p_r$, while sensor 64 effectively measures pc. While separate sensors 62 and 64 are shown in FIG. 5, in certain embodiments sensors 62 and 64 can be replaced by a single pressure differential sensor. Where a pressure differential sensor is used, a first end of the sensor is connected upstream of first control device 14 and a second end of the sensor is connected downstream from first control device 14.

OCRS 11*c* also includes optional pressure sensors 66 and 68 positioned at the inlet and outlet, respectively, of evaporator 16. Sensor 66 measures and transmits information about the refrigerant fluid pressure upstream from evaporator 16, and sensor 68 measures and transmits information about the refrigerant fluid pressure downstream from evaporator 16. This information can be used (e.g., by a system controller) to calculate the refrigerant fluid pressure drop across evaporator 16.

As above, in certain embodiments, sensors 66 and 68 can be replaced by a single pressure differential sensor, a first end of which is connected adjacent to the evaporator inlet and a second end of which is connected adjacent to the evaporator outlet. The pressure differential sensor measures and transmits information about the refrigerant fluid pressure drop across evaporator 16.

To measure the evaporating pressure ($p_e$), sensor 68 can be optionally positioned between the inlet and outlet of evaporator 16, i.e., internal to evaporator 16. In such a configuration, sensor 68 can provide a direct a direct measurement of the evaporating pressure.

To measure refrigerant fluid pressure at other locations within OCRS 11*c*, sensor 68 can also optionally be positioned at a location different from the one shown in FIG. 5. For example, sensor 68 can be located in-line along conduit 26. Alternatively, sensor 68 can be positioned at or near an inlet of second control device 18. Pressure sensors at each of these locations can be used to provide information about the refrigerant fluid pressure downstream from evaporator 16, or the pressure drop across evaporator 16.

OCRS 11*c* includes an optional temperature sensor 74 which can be positioned adjacent to an inlet or an outlet of evaporator 16, or between the inlet and the outlet. Sensor 74 measures temperature information for the refrigerant fluid within evaporator 16 (which represents the evaporating temperature) and transmits an electronic signal corresponding to the measured information. OCRS 11*c* also includes an optional temperature sensor 76 attached to heat load 20, which measures temperature information for the load and transmits an electronic signal corresponding to the measured information.

OCRS 11*c* includes an optional temperature sensor 70 adjacent to the outlet of evaporator 16 that measures and transmits information about the temperature of the refrigerant fluid as it emerges from evaporator 16.

In certain embodiments, the systems disclosed herein are configured to determine superheat information for the refrigerant fluid based on temperature and pressure information for the refrigerant fluid measured by any of the sensors disclosed herein. The superheat of the refrigerant vapor refers to the difference between the temperature of the refrigerant fluid vapor at a measurement point in the system and the saturated vapor temperature of the refrigerant fluid defined by the refrigerant pressure at the measurement point in the system.

To determine the superheat associated with the refrigerant fluid, a system controller (as will be described in greater detail subsequently) receives information about the refrigerant fluid vapor pressure after emerging from a heat exchanger downstream from evaporator 16, and uses calibration information, a lookup table, a mathematical relationship, or other information to determine the saturated vapor temperature for the refrigerant fluid from the pressure information. The controller also receives information about the actual temperature of the refrigerant fluid, and then calculates the superheat associated with the refrigerant fluid as the difference between the actual temperature of the refrigerant fluid and the saturated vapor temperature for the refrigerant fluid.

The foregoing temperature sensors can be implemented in a variety of ways in OCRS 11*c*. As one example, thermocouples and thermistors can function as temperature sensors in OCRS 11*c*. Examples of suitable commercially available temperature sensors for use in OCRS 11*c* include, but are not limited to the 88000 series thermocouple surface probes (available from OMEGA Engineering Inc., Norwalk, Conn.).

OCRS 11*ab* includes a vapor quality sensor 72 that measures vapor quality of the refrigerant fluid emerging from evaporator 16. Typically, sensor 72 is implemented as a capacitive sensor that measures a difference in capacitance between the liquid and vapor phases of the refrigerant fluid. The capacitance information can be used to directly determine the vapor quality of the refrigerant fluid (e.g., by a system controller). Alternatively, sensor 72 can determine the vapor quality directly based on the differential capacitance measurements and transmit an electronic signal that includes information about the refrigerant fluid vapor quality. Examples of commercially available vapor quality sensors that can be used in system OCRS 11*e* include, but are not limited to HBX sensors (available from HB Products, Hasselager, Denmark).

It should be appreciated that in the foregoing discussion, any one or various combinations of two or more sensors discussed in connection with OCRS 11*c* can correspond to the first measurement device connected to first control device 14, and any one or various combinations of two or more sensors can correspond to the second measurement device connected to second control device 18. In general, as discussed previously, the first measurement device provides information corresponding to a first thermodynamic quantity to the first control device 14, and the second measurement device provides information corresponding to a second thermodynamic quantity to the second control device 18, where the first and second thermodynamic quantities are different, and therefore allow the first and second control device to independently control two different system properties (e.g., the vapor quality of the refrigerant fluid and the heat load temperature, respectively).

It should also be understood that third control device 38, if present in OCRS 11*c*, can be adjusted based on a measurement of vapor pressure within receiver resonator 12 and/or by mechanical force applied to a diaphragm within third control device by vapor in conduit 130 or receiver resonator 12.

In some embodiments, one or more of the sensors shown in OCRS 11*c* are connected directly to first control device 14 and/or to second control device 18. The first and second control device can be configured to adaptively respond directly to the transmitted signals from the sensors, thereby providing for automatic adjustment of the system's operating parameters. In certain embodiments, the first and/or second control device can include processing hardware and/or software components that receive transmitted signals from the sensors, optionally perform computational operations, and activate elements of the first and/or second control device to adjust the control device in response to the sensor signals.

In some embodiments, the systems disclosed herein include a system controller that receives measurement signals from one or more system sensors and transmits control signals to the first and/or second measurement device to independently adjust the refrigerant fluid vapor quality and the heat load temperature.

Figure 6:
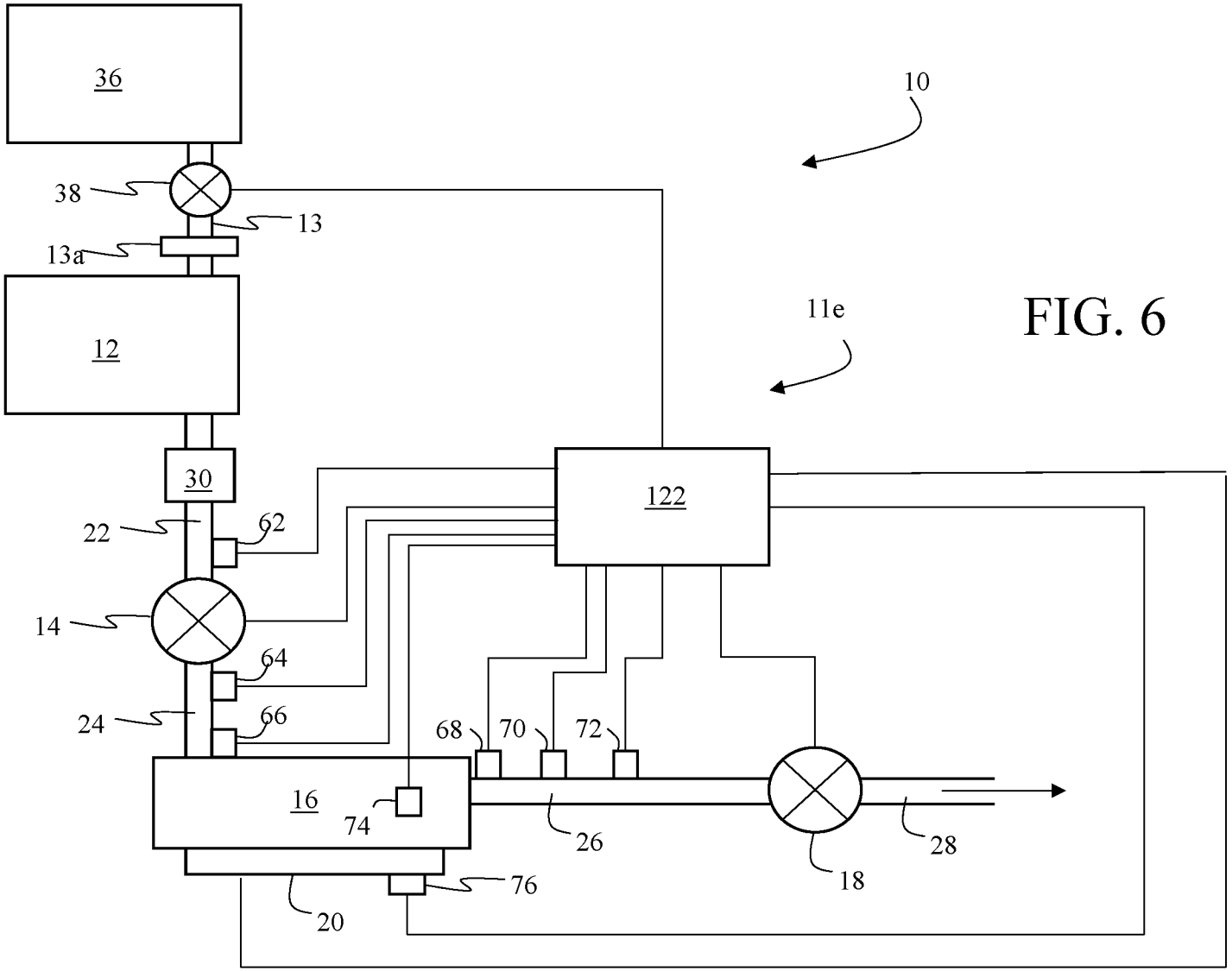
FIG. 6 is a schematic diagram of an example of a thermal management system that includes one or more sensors connected to a controller.

FIG. 6 shows system 10 with an OCRS system 11*e* that includes a system controller 122 connected to one or more of the optional sensors 62-76 discussed above, and configured to receive measurement signals from each of the connected sensors. In FIG. 6, connections are shown between each of the sensors and controller 122 for illustrative purposes. In many embodiments, however, system 1*e* includes only certain combinations of the sensors shown in FIG. 6 (e.g., one, two, three, or four of the sensors) to provide suitable control signals for the first and/or second control device.

In addition, controller 122 is optionally connected to first control device 14 and second control device 18. In embodiments where either first control device 14 or second control device 18 (or both) is/are implemented as a device controllable via an electrical control signal, controller 122 is configured to transmit suitable control signals to the first and/or second control device to adjust the configuration of these components. In particular, controller 122 is optionally configured to adjust first control device 14 to control the vapor quality of the refrigerant fluid in system 11*e*, and optionally configured to adjust second control device 18 to control the temperature of heat load 20.

During operation of system 11*e*, controller 122 typically receives measurement signals from one or more sensors. The measurements can be received periodically (e.g., at consistent, recurring intervals) or irregularly, depending upon the nature of the measurements and the manner in which the measurement information is used by controller 122. In some embodiments, certain measurements are performed by controller 122 after particular conditions—such as a measured parameter value exceeding or falling below an associated set point value—are reached.

It should generally understood that the systems disclosed herein can include a variety of combinations of the various sensors described above, and controller 122 can receive measurement information periodically or aperiodically from any of the various sensors. Moreover, it should be understood any of the sensors described can operate autonomously, measuring information and transmitting the information to controller 122 (or directly to the first and/or second control device), or alternatively, any of the sensors described above can measure information when activated by controller 122 via a suitable control signal, and measure and transmit information to controller 122 in response to the activating control signal.

By way of example, Table 1 summarizes various examples of combinations of types of information (e.g., system properties and thermodynamic quantities) that can be measured by the sensors of system 11*e* and transmitted to controller 122, to allow controller 122 to generate and transmit suitable control signals to first control device 14 and/or second control device 18. The types of information shown in Table 1 can generally be measured using any suitable device (including combination of one or more of the sensors discussed herein) to provide measurement information to controller 122.

TABLE 1

| | | Measurement Information Used to Adjust First Control device | | | | | | | |
|---|---|---|---|---|---|---|---|---|---|
| | | FCM Press Drop | Evap Pres Drop | Rec Pres | VQ | SH | Evap VQ | Evap P/T | HL Temp |
| Measurement Information Used to Adjust Second Control device | FCM Press Drop | | | | | | | x | x |
| | Evap Press Drop | | | | | | | x | x |
| | Rec Press | | | | | | | x | x |
| | VQ | | | | | | | x | x |
| | SH | | | | | | | x | x |
| | Evap VQ | | | | | | | x | x |
| | Evap P/T | x | x | x | x | x | x | | x |
| | HL Temp | x | x | x | x | x | x | x | |

FCM Press Drop = refrigerant fluid pressure drop across first control device
Evap Press Drop = refrigerant fluid pressure drop across evaporator
Rec Press = refrigerant fluid pressure in receiver
VQ = vapor quality of refrigerant fluid
SH = superheat of refrigerant fluid
Evap VQ = vapor quality of refrigerant fluid at evaporator outlet
Evap P/T = evaporation pressure or temperature
HL Temp = heat load temperature For example, in some embodiments, first control device 14 is adjusted (e.g., automatically or by controller 122) based on a measurement of the evaporation pressure ($p_e$) of the refrigerant fluid and/or a measurement of the evaporation temperature of the refrigerant fluid. With first control device 14 adjusted in this manner, second control device 18 can be adjusted (e.g., automatically or by controller 122) based on measurements of one or more of the following system parameter values: the pressure drop across first control device 14, the pressure drop across evaporator 16, the refrigerant fluid pressure in refrigerant receiver 12, the vapor quality of the refrigerant fluid emerging from evaporator 16 (or at another location in the system), the superheat value of the refrigerant fluid, and the temperature of thermal load 20.

In certain embodiments, first control device 14 is adjusted (e.g., automatically or by controller 122) based on a measurement of the temperature of thermal load 20. With first control device 14 adjusted in this manner, second control device 18 can be adjusted (e.g., automatically or by controller 122) based on measurements of one or more of the following system parameter values: the pressure drop across first control device 14, the pressure drop across evaporator 16, the refrigerant fluid pressure in refrigerant receiver 12, the vapor quality of the refrigerant fluid emerging from evaporator 16 (or at another location in the system), the superheat value of the refrigerant fluid, and the evaporation pressure ($p_e$) and/or evaporation temperature of the refrigerant fluid.

In some embodiments, controller 122 second control device 18 based on a measurement of the evaporation pressure pc of the refrigerant fluid downstream from first control device 14 (e.g., measured by sensor 64 or 66) and/or a measurement of the evaporation temperature of the refrigerant fluid (e.g., measured by sensor 74). With second control device 18 adjusted based on this measurement, controller 122 can adjust first control device 14 based on measurements of one or more of the following system parameter values: the pressure drop ($p_r$–$p_e$) across first control device 14, the pressure drop across evaporator 16, the refrigerant fluid pressure in refrigerant receiver 12 ($p_r$), the vapor quality of the refrigerant fluid emerging from evaporator 16 (or at another location in the system), the superheat value of the refrigerant fluid in the system, and the temperature of thermal load 20.

In certain embodiments, controller 122 adjusts second control device 18 based on a measurement of the temperature of thermal load 20 (e.g., measured by sensor 124). Controller 122 can also adjust first control device 14 based on measurements of one or more of the following system parameter values: the pressure drop ($p_r$–$p_e$) across first control device 14, the pressure drop across evaporator 16, the refrigerant fluid pressure in refrigerant receiver 12 ($p_r$), the vapor quality of the refrigerant fluid emerging from evaporator 16 (or at another location in the system), the superheat value of the refrigerant fluid in the system, the evaporation pressure ($p_e$) of the refrigerant fluid, and the evaporation temperature of the refrigerant fluid.

To adjust either first control device 14 or second control device 18 based on a particular value of a measured system parameter value, controller 122 compares the measured value to a set point value (or threshold value) for the system parameter. Certain set point values represent a maximum allowable value of a system parameter, and if the measured value is equal to the set point value (or differs from the set point value by 10% or less (e.g., 5% or less, 3% or less, 1% or less) of the set point value), controller 122 adjusts first control device 14 and/or second control device 18 to adjust the operating state of the system, and reduce the system parameter value.

Certain set point values represent a minimum allowable value of a system parameter, and if the measured value is equal to the set point value (or differs from the set point value by 10% or less (e.g., 5% or less, 3% or less, 1% or less) of the set point value), controller 122 adjusts first control device 14 and/or second control device 18 to adjust the operating state of the system, and increase the system parameter value.

Some set point values represent "target" values of system parameters. For such system parameters, if the measured parameter value differs from the set point value by 1% or more (e.g., 3% or more, 5% or more, 10% or more, 20% or more), controller 122 adjusts first control device 14 and/or second control device 18 to adjust the operating state of the system, so that the system parameter value more closely matches the set point value.

In the foregoing examples, measured parameter values are assessed in relative terms based on set point values (i.e., as a percentage of set point values). Alternatively, in some embodiments, measured parameter values can be asses in absolute terms. For example, if a measured system parameter value differs from a set point value by more than a certain amount (e.g., by 1 degree C. or more, 2 degrees C. or more, 3 degrees C. or more, 4 degrees C. or more, 5 degrees C. or more), then controller 122 adjusts first control device 14 and/or second control device 18 to adjust the operating state of the system, so that the measured system parameter value more closely matches the set point value.

In some embodiments, one or more signals from a heat load can be used to adjust first control device 14 and/or second control device 18.

As shown in FIG. 6, controller 122 can optionally be connected to a heat load such as heat load 20, and can receive signals transmitted from heat load 20. Such signals can include, but are not limited to, information about various operating parameters of heat load 20. The information encoded in such signals can correspond, for example, to an operating power of heat load 20, an output energy of heat load 20, an electrical voltage or current within heat load 20, or more generally, any one or more of a wide variety of different operating parameters of the heat load. Controller 122 can then compare the received information to one or more corresponding set point values for the operating parameters of heat load 20, and adjust first control device 14 and/or second control device 18 to alter the operating state of the system based on the one or more operating parameters of heat load 20.

As one example, heat load 20 can transmit to controller 122 a signal that includes information about a total output power of heat load 20 during operation of the heat load. In this example, heat load 20 might correspond, for example, to one or more laser diodes. Controller 122 then use the received information to adjust a flow rate of refrigerant fluid through the system to cool heat load 20 by adjusting first control device 14 and/or second control device 18 accordingly. When the total output power of heat load 20 reaches a maximum value for example, controller 122 may adjust the refrigerant fluid flow rate through the system to a corresponding maximum value, e.g., by fully opening first control device 14.

In certain embodiments, refrigerant fluid emerging from evaporator 16 can be used to cool one or more additional thermal loads.

Figure 7:
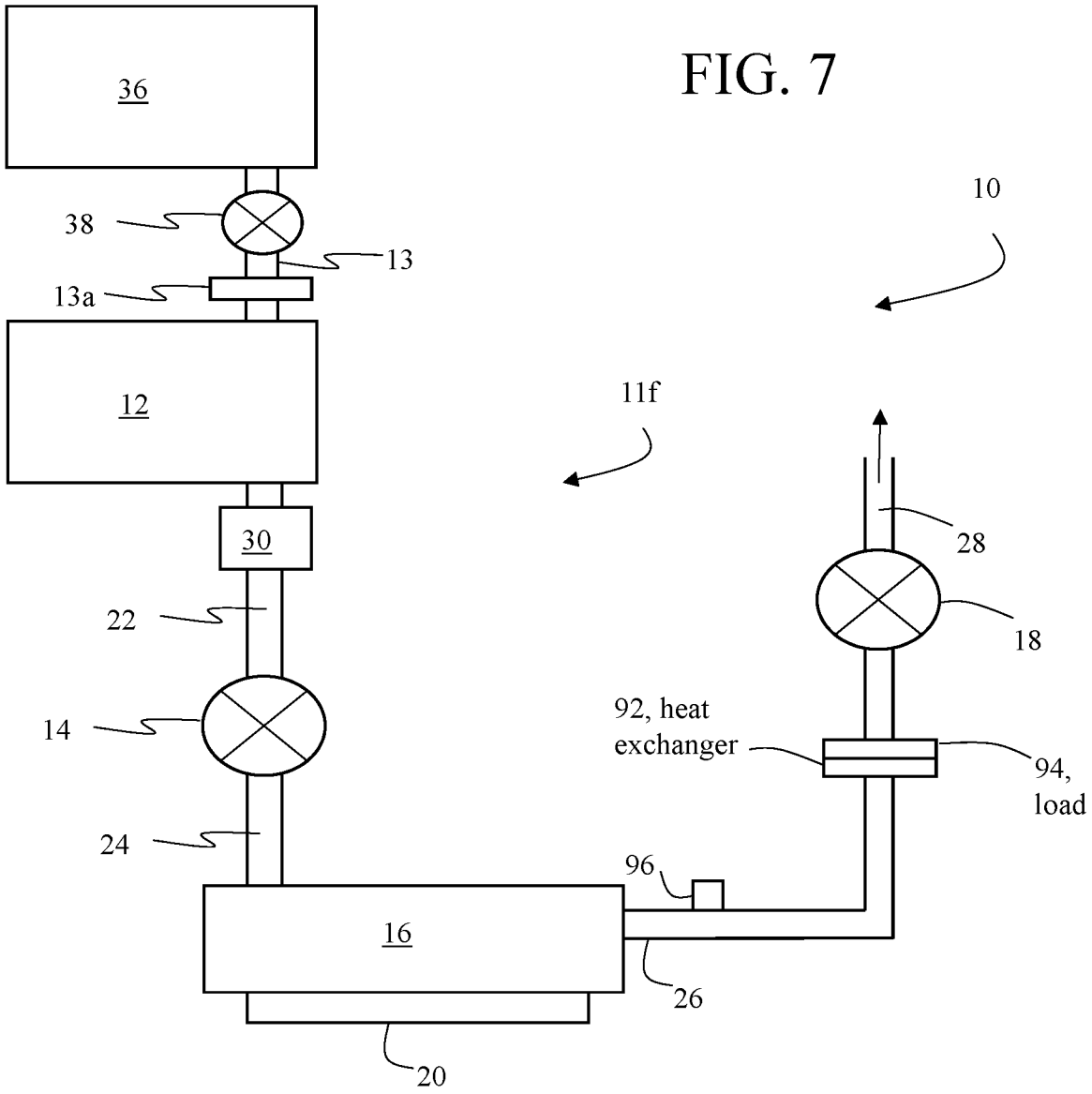
FIG. 7 is a schematic diagram of an example of a thermal management system that includes an evaporator for extracting heat energy from a first thermal load and a heat exchanger for extracting heat energy from a second thermal load.
Figure 8:
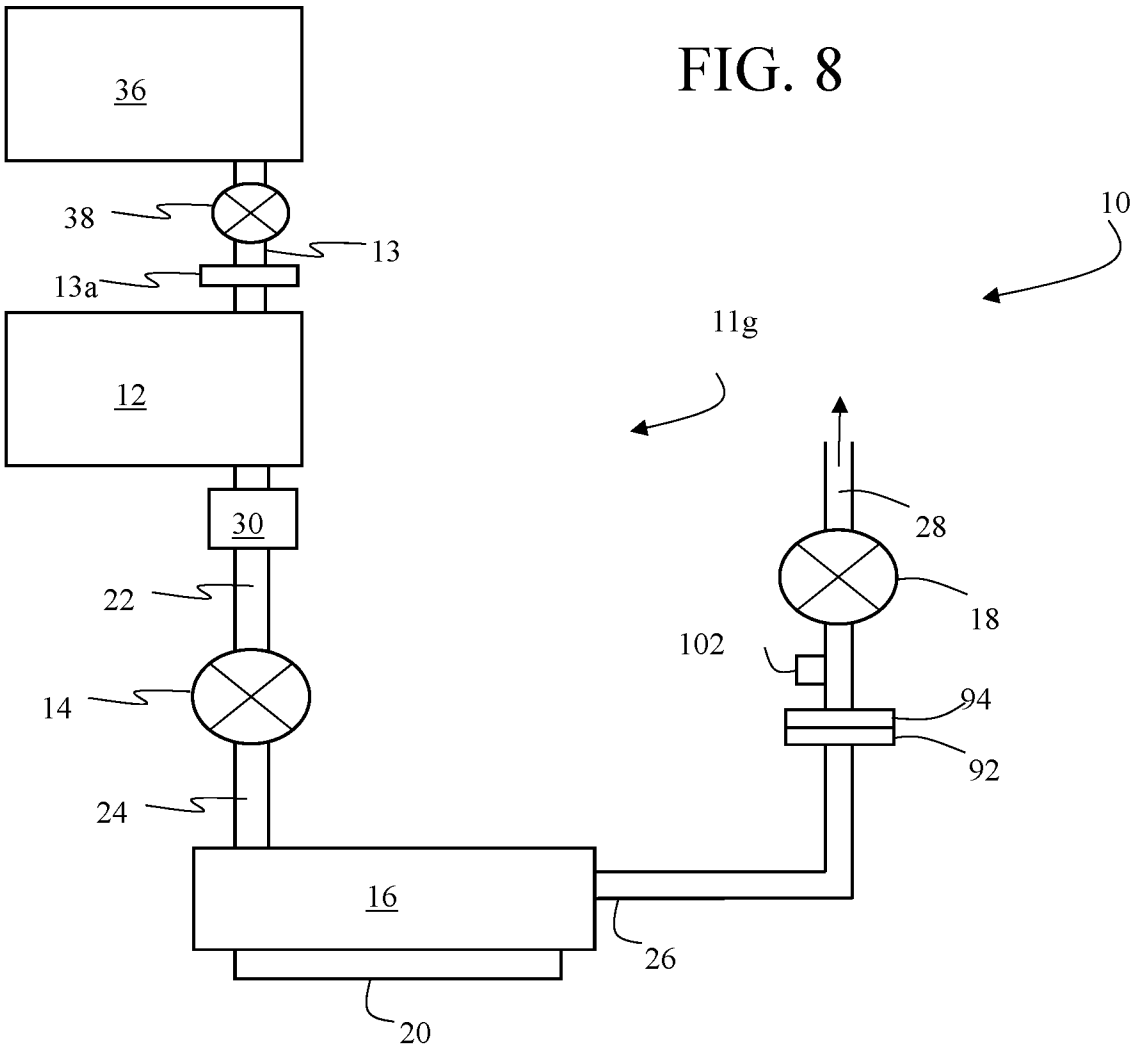
FIG. 8 is a schematic diagram of another example of a thermal management system that includes an evaporator for extracting heat energy from a first thermal load and a heat exchanger for extracting heat energy from a second thermal load.

FIGS. 7 and 8 show thermal management systems 10 with other embodiments of OCRS configurations, e.g., OCRS 11*f* and OCRS 11*g* that include many of the features discussed previously. In addition, OCRS 11*f* and OCRS 11*g* include a second thermal load 94 connected to a heat exchanger 92. A variety of mechanical connections can be used to attach second thermal load 94 to heat exchanger 92, including (but not limited to) brazing, clamping, welding, and any of the other connection types discussed herein.

Heat exchanger 92 includes one or more flow channels through which high vapor quality refrigerant fluid flows after leaving evaporator 16. During operation, as the refrigerant fluid vapor basses through the flow channels, it absorbs heat energy from second thermal load 94, cooling second thermal load 94. Typically, second thermal load 94 is not as sensitive as thermal load 20 to fluctuations in temperature. Accordingly, while second thermal load 94 is generally not cooled as precisely relative to a particular temperature set point value as thermal load 20, the refrigerant fluid vapor provides cooling that adequately matches the temperature constraints for second thermal load 94.

Although in FIGS. 7 and 8 only one additional thermal load (i.e., second thermal load 94) is shown, in general the systems disclosed herein can include more than one (e.g., two or more, three or more, four or more, five or more, or even more) thermal loads in addition to thermal load 94.

Each of the additional thermal loads can have an associated heat exchanger; in some embodiments, multiple additional thermal loads are connected to a single heat exchanger, and in certain embodiments, each additional thermal load has its own heat exchanger. Moreover, each of the additional thermal loads can be cooled by the superheated refrigerant fluid vapor after a heat exchanger attached to the second load or cooled by the high vapor quality fluid stream that emerges from evaporator 16.

In certain embodiments, one or more additional thermal loads (e.g., second thermal load 94) can optionally be connected to controller 122 in a manner analogous to thermal load 20 in FIG. 6. Signals from the one or more additional thermal loads can be transmitted to controller 122, which can use information derived from the transmitted signals to alter operation of the system (e.g., the refrigerant fluid flow rate through the system) based on the information from the transmitted signals, by adjusting first control device 14 and/or second control device 18. The nature of the transmitted information from the one or more additional thermal loads can be similar to the nature of the transmitted information from thermal load 20 described above. It should be noted that in some embodiments, controller 122 adjusts system operation based on one or more transmitted signals from one or more additional thermal loads alone; adjustment of the system does not occur based on transmitted signals from thermal load 20, and controller 122 may not even receive signals from, or even be connected to, thermal load 20. Alternatively, in certain embodiments, controller 122 can receive signals from both thermal load 20 and from one or more additional thermal loads (such as second thermal load 94), and can adjust the operation of the system based on information derived from the multiple received signals.

Although evaporator 16 and heat exchanger 92 are implemented as separate components in FIGS. 7 and 8, in certain embodiments, these components can be integrated to form a single heat exchanger, with thermal load 20 and second thermal load 94 both connected to the single heat exchanger. The refrigerant fluid vapor that is discharged from the evaporator portion of the single heat exchanger is used to cool second thermal load 94, which is connected to a second portion of the single heat exchanger.

In FIGS. 7 and 8, the vapor quality of the refrigerant fluid after passing through evaporator 16 can be controlled either directly or indirectly with respect to a vapor quality set point by controller 122. In some embodiments, as shown in FIG. 7, the system includes a vapor quality sensor 96 that provides a direct measurement of vapor quality which is transmitted to controller 122. Controller 122 adjusts first control device 14 to control the vapor quality relative to the vapor quality set point value.

In certain embodiments, as shown in FIG. 8, the system 10 includes OCRS 11*g* that includes a sensor 102 that measures superheat, and indirectly, vapor quality. For example, in FIG. 8, sensor 102 is a combination of temperature and pressure sensors that measures the refrigerant fluid superheat downstream from the second heat load 94, and transmits the measurements to controller 122. Controller 122 adjusts first control device 14 based on the measured superheat relative to a superheat set point value. By doing so, controller 122 indirectly adjusts the vapor quality of the refrigerant fluid emerging from evaporator 16.

In some embodiments, controller 122 can adjust second control device 18 based on measurements of the superheat value of the refrigerant fluid vapor that are performed downstream from a second thermal load that is cooled by the superheated refrigerant fluid vapor.

Although heat exchanger 92 and second heat load 94 are positioned upstream from second control device 18 in FIGS. 7 and 8, in some embodiments, heat exchanger 92 and second heat load 94 can be positioned downstream from second control device 18. Positioning heat exchanger 92 and second thermal load 94 downstream from second control device 18 can have certain advantages. Depending upon the system's various operating parameter settings, refrigerant fluid emerging from evaporator 16 can include some liquid refrigerant which may not effectively cool second thermal load 94. Prior to entering heat exchanger 92, however, the refrigerant fluid can be converted entirely to the vapor phase in second control device 18, so that the refrigerant fluid entering heat exchanger 92 consists entirely of refrigerant vapor.

Further, in some embodiments, sensor 102 can be positioned downstream from second control device 18. As discussed above, measured superheat information can be used to adjust first control device 14 (e.g., to indirectly control vapor quality at the outlet of evaporator 16).

In certain embodiments, the thermal management systems disclosed herein can include a recuperative heat exchanger for transferring heat energy from the refrigerant fluid emerging from evaporator 16 to refrigerant fluid upstream from first control device 14.

Figure 9A:
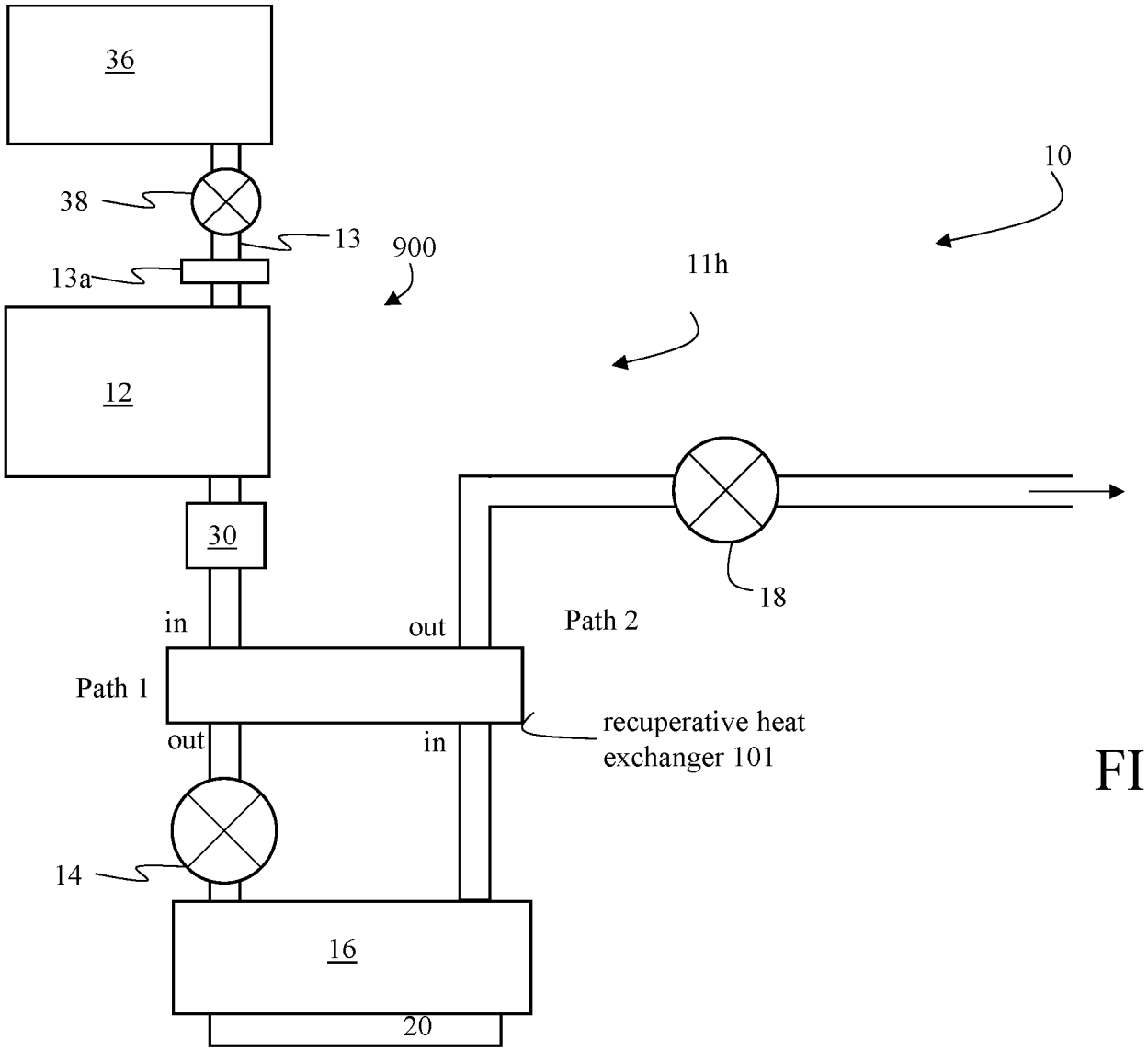
FIG. 9A is a schematic diagram of an example of a thermal management system that includes a recuperative heat exchanger.

FIG. 9A depicts a thermal management system 10 that includes an OCRS 11*h* that includes many of the features discussed previously. In addition, OCRS 11*h* includes a recuperative heat exchanger 101. Recuperative heat exchanger 101 includes a first flow path for refrigerant fluid flowing from refrigerant receiver 12 to first control device 14, and a second flow path for refrigerant fluid flowing in a counter-propagating direction from evaporator 16. The recuperative heat exchanger is useful when there is no second heat load in OCRS 11*h* or when all heat loads are cooled by the evaporator(s) only.

As the two refrigerant fluid streams flow in opposite directions within recuperative heat exchanger 101, heat is transferred from the refrigerant fluid emerging from evaporator 16 to the refrigerant fluid entering first control device 14. Heat transfer between the refrigerant fluid streams can have a number of advantages. For example, recuperative heat transfer can increase the refrigeration effect in evaporator 16, thereby reducing the refrigerant mass transfer rate implemented to handle the heat load presented by thermal load 20. Further, by reducing the refrigerant mass transfer rate through evaporator 16, the amount of refrigerant used to provide cooling duty in a given period of time is reduced. As a result, for a given initial quantity of refrigerant fluid introduced into refrigerant receiver 12, the operational time over which the system can operate before an additional refrigerant fluid charge is needed can be extended. Alternatively, for the system to effectively cool thermal load 20 for a given period of time, a smaller initial charge of refrigerant fluid into refrigerant receiver 12 can be used.

Figure 9B:
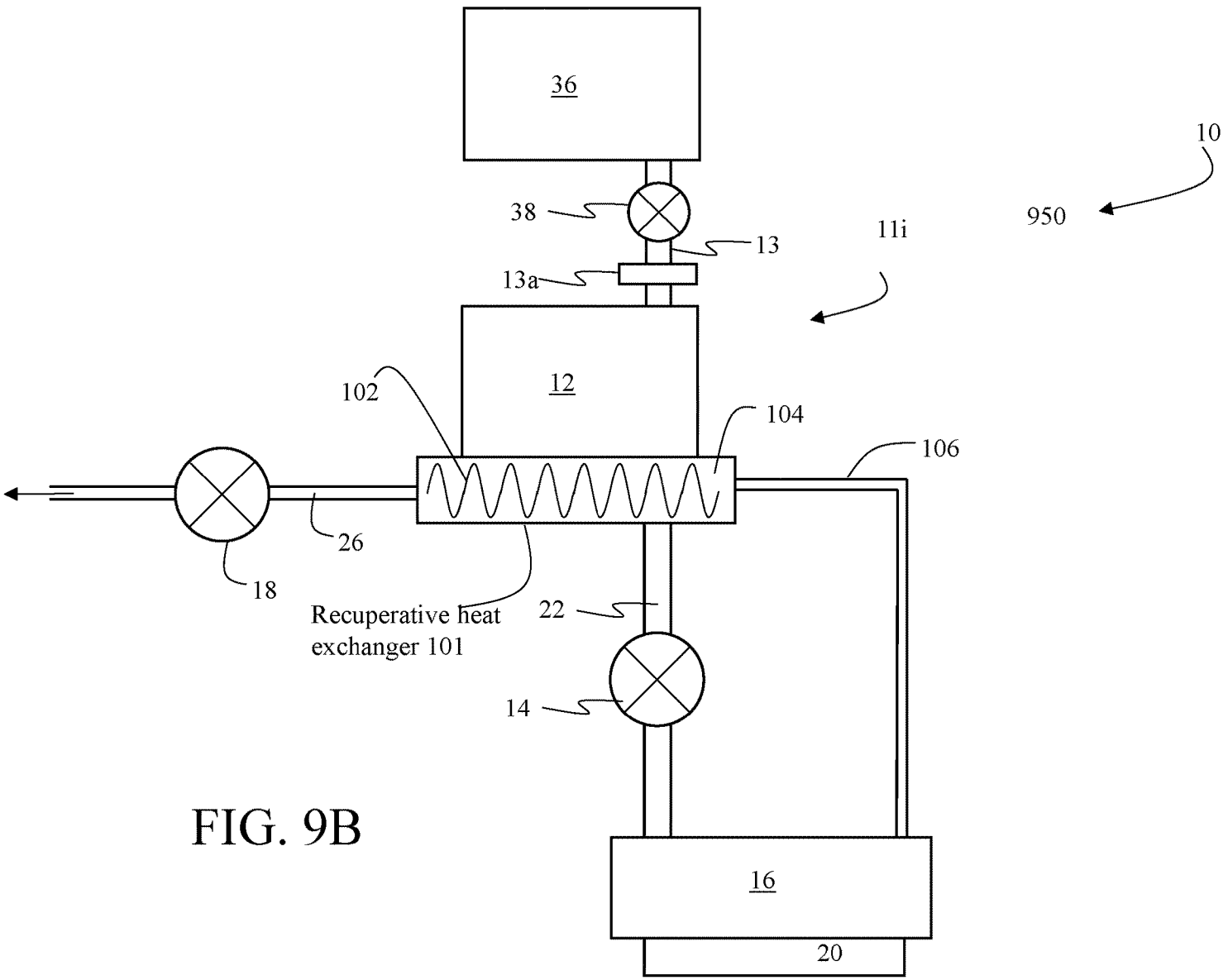
FIG. 9B is a schematic diagram of an example of a thermal management system that includes a recuperative heat exchanger in thermal contact with a refrigerant receiver.

In some embodiments, recuperative heat exchanger 101 can be integrated with refrigerant receiver 12. FIG. 9B is a schematic diagram of a thermal management system 10 using an OCRS 11*i* that includes many of the features discussed previously, including a recuperative heat exchanger 101.

In FIG. 9B, recuperative heat exchanger 101 provides a thermal contact between liquid refrigerant emerging from refrigerant receiver 12 and refrigerant fluid (e.g., refrigerant vapor) emerging from evaporator 16. Recuperative heat exchanger 101 includes a first flow path that extends from refrigerant receiver 12 through the open region 104 of recuperative heat exchanger 101 and into conduit 22. Refrigerant fluid (i.e., in the liquid phase) from refrigerant receiver 12 follows the first flow path to first control device 14.

Recuperative heat exchanger 101 also includes a second flow path that extends from conduit 106 through an internal coil 102 and into conduit 26. Refrigerant vapor emerging from evaporator 16 flows through conduit 106 and enters recuperative heat exchanger 101, where it flows through coil 102 before exiting the recuperative heat exchanger into conduit 26.

The first and second flow paths within recuperative heat exchanger 101 ensure that thermal contact occurs between the liquid refrigerant fluid from refrigerant receiver 12 and the refrigerant vapor from evaporator 16, so that heat is transferred from the refrigerant vapor to the liquid refrigerant fluid. As discussed above, by transferring heat to the liquid refrigerant fluid in this manner, the refrigeration effect in evaporator 16 can be increased, and the refrigerant fluid mass transfer rate implemented to handle the heat load presented by thermal load 20 can be reduced.

The second flow path through recuperative heat exchanger 101 is shown schematically in FIG. 9B as coil 102. In general, coil 102 can be formed from various types of heat exchanger elements, including but not limited to conventional tubes or conduits, mini-channel tubes, and cold plate tubes. In addition, while coil 102 is shown schematically as having a serpentine or helical shape, more generally coil 102 can include fluid channels having a wide variety of shapes, and defining fluid flow paths of many different shapes, including but not limited to zig-zag paths, linear paths, circular and/or spiral paths, rectangular paths, and multi-channel paths.

Because the liquid and vapor phases of the two-phase mixture of refrigerant fluid generated following expansion of the refrigerant fluid in first control device 14 can be used for different cooling applications, in some embodiments, the system can include a phase separator to separate the liquid and vapor phases into separate refrigerant streams that follow different flow paths within the system.

Figure 10:
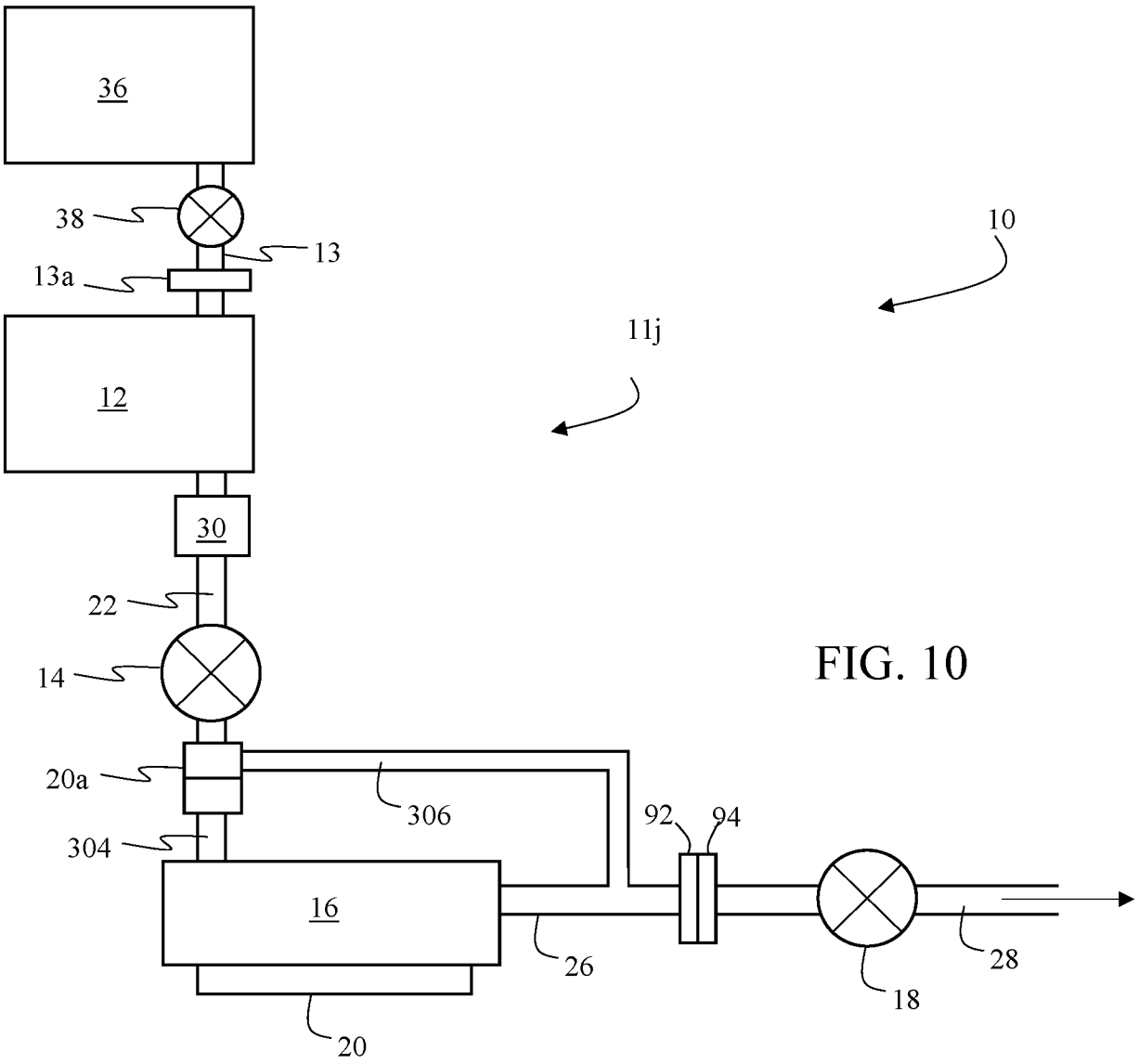
FIG. 10 is a schematic diagram of an example of a thermal management system that includes a refrigerant fluid phase separator.

FIG. 10 shows an example of a thermal management system 10 using an OCRS 11*j* that includes many features that are similar to those discussed previously. In addition, OCRS 11*j* also includes a phase separator 20*a* that separates the refrigerant fluid stream emerging from first control device 14 into a vapor phase, which is directed into conduit 306, and a liquid phase, which is directed into conduit 304. The liquid phase enters evaporator 16 and is used to cool thermal load 20, as discussed above. The vapor phase is combined with the refrigerant fluid emerging from evaporator 16 and directed into heat exchanger 92, where it is used to cool second thermal load 94 if the second thermal load exists.

Because the liquid phase of the refrigerant fluid is more dense than the vapor phase, phase separator 20*a* can separate the two refrigerant phases by gravitational action, drawing off the vapor phase near the top of the phase separator and the liquid phase near the bottom of the phase separator as shown in FIG. 10.

Separating the liquid and vapor phases into two different refrigerant fluid streams can have a number of advantages. For example, by directing a nearly vapor-free liquid refrigerant fluid into the inlet of evaporator 16, the fluid channels within the evaporator can have smaller cross-sectional areas than fluid channels that carry a mixture of liquid and vapor phases of the refrigerant fluid. By reducing the cross-sectional areas of the fluid channels, the overall system weight can be reduced.

Further, eliminating (or nearly eliminating) the refrigerant vapor from the refrigerant fluid stream entering evaporator 16 can help to reduce the cross-section of the evaporator and improve film boiling in the refrigerant channels. In film boiling, the liquid phase (in the form of a film) is physically separated from the walls of the refrigerant channels by a layer of refrigerant vapor, leading to poor thermal contact and heat transfer between the refrigerant liquid and the refrigerant channels. Reducing film boiling improves the efficiency of heat transfer and the cooling performance of evaporator 16.

In addition, by eliminating (or nearly eliminating) the refrigerant vapor from the refrigerant fluid stream entering evaporator 16, distribution of the liquid refrigerant within the channels of evaporator 16 can be made easier. In certain embodiments, vapor present in the refrigerant channels of evaporator 16 can oppose the flow of liquid refrigerant into the channels. Diverting the vapor phase of the refrigerant fluid before the fluid enters evaporator 16 can help to reduce this difficulty.

In addition to phase separator 20*a*, or as an alternative to phase separator 20*a*, in some embodiments the systems disclosed herein can include a phase separator downstream from evaporator 16. Such a configuration can be used when the refrigerant fluid emerging from evaporator is not entirely in the vapor phase, and still includes liquid refrigerant fluid.

Figure 11:
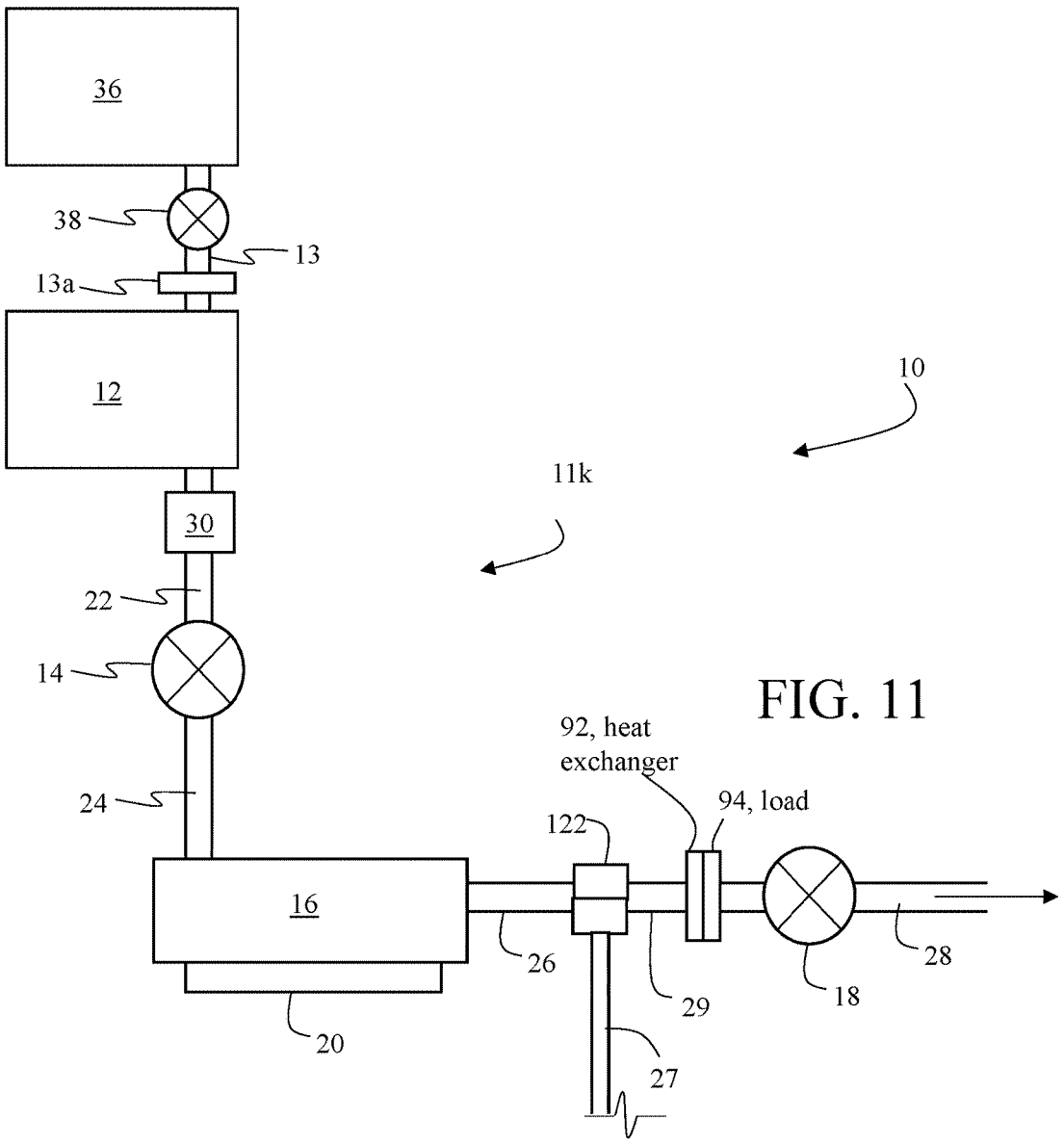
FIG. 11 is a schematic diagram of another example of a thermal management system that includes a refrigerant fluid phase separator.

FIG. 11 shows an example of a OCRS 11*k* that includes many features that are similar to those discussed previously. In addition, system 20 also includes a phase separator 120*a* downstream from evaporator 16. Phase separator 120 receives the refrigerant fluid (a mixture of liquid and vapor phases) from evaporator 16 through conduit 26 and separates the phases. Liquid refrigerant fluid is directed through conduit 27 and can be reintroduced, for example, into conduit 24, upstream from evaporator 16, so it can be used to cool heat load 20. Refrigerant fluid vapor can be transported through conduit 29 and into heat exchanger 92, where it can be used to cool second heat load 94 (if it exists).

In certain embodiments, the systems can include both a phase separator as shown in FIGS. 10 and 11, and a recuperative heat exchanger as shown in FIG. 9B. Refrigerant fluid vapor separated from a mixture of refrigerant fluid phases by phase separator 20*a* and/or phase separator 120*a* can be directed into a conduit and transported to recuperative heat exchanger 101 shown in FIG. 9B, where heat is transferred from the refrigerant vapor to refrigerant liquid emerging from refrigerant receiver 12. As discussed above, transferring heat from the vapor phase of the refrigerant fluid to the liquid phase of the refrigerant fluid can increase the refrigeration effect of evaporator 16 and reduce the mass flow rate of refrigerant fluid through the system.

IV. Additional Features of Thermal Management Systems

The foregoing examples of thermal management systems illustrate a number of features that can be included in any of the systems within the scope of this disclosure. In addition, a variety of other features can be present in such systems.

In certain embodiments, refrigerant fluid that is discharged from evaporator 16 and passes through conduit 26 and second control device 18 can be directly discharged as exhaust from conduit 28 without further treatment. Direct discharge provides a convenient and straightforward method for handling spent refrigerant, and has the added advantage that over time, the overall weight of the system is reduced due to the loss of refrigerant fluid. For systems that are mounted to small vehicles or are otherwise mobile, this reduction in weight can be important.

In some embodiments, however, refrigerant fluid vapor can be further processed before it is discharged. Further processing may be desirable depending upon the nature of the refrigerant fluid that is used, as direct discharge of unprocessed refrigerant fluid vapor may be hazardous to humans and/or may deleterious to mechanical and/or electronic devices in the vicinity of the system. For example, the unprocessed refrigerant fluid vapor may be flammable or toxic, or may corrode metallic device components. In situations such as these, additional processing of the refrigerant fluid vapor may be desirable.

Figure 12A:
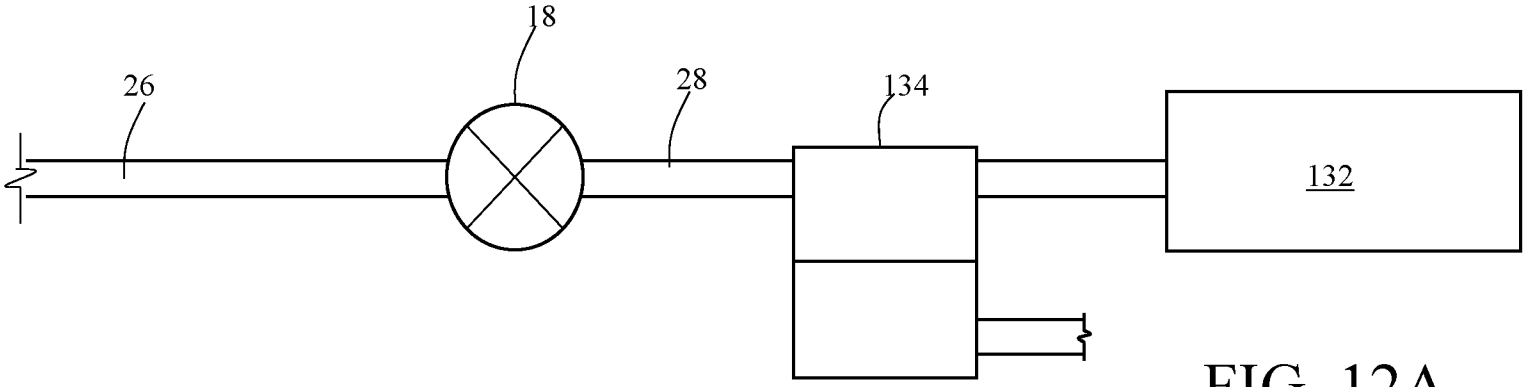
FIGS. 12A and 12B are schematic diagrams showing example portions of thermal management systems that include a refrigerant fluid processing apparatus.
Figure 12B:
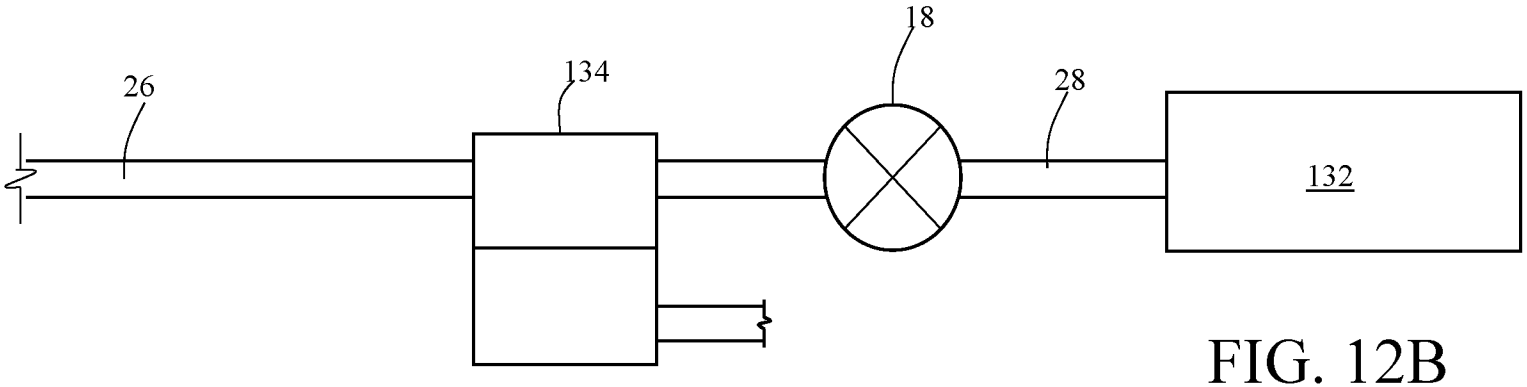

FIGS. 12A and 12B show portions of thermal management systems 10 with portions of an OCRS (not referenced, but could be any of those discussed above) in which a refrigerant processing apparatus 132 is connected to conduit 28. Spend refrigerant fluid vapor is directed into apparatus 132 where it is further processed. In general, refrigerant processing apparatus 132 can be implemented in various ways. In some embodiments, refrigerant processing apparatus 132 is a chemical scrubber or water-based scrubber. Within apparatus 132, the refrigerant fluid is exposed to one or more chemical agents that treat the refrigerant fluid vapor to reduce its deleterious properties. For example, where the refrigerant fluid vapor is basic (e.g., ammonia) or acidic, the refrigerant fluid vapor can be exposed to one or more chemical agents that neutralize the vapor and yield a less basic or acidic product that can be collected for disposal or discharged from apparatus 132.

As another example, where the refrigerant fluid vapor is highly chemically reactive, the refrigerant fluid vapor can be exposed to one or more chemical agents that oxidize, reduce, or otherwise react with the refrigerant fluid vapor to yield a less reactive product that can be collected for disposal or discharged from apparatus 132.

In certain embodiments, refrigerant processing apparatus 132 can be implemented as an adsorptive sink for the refrigerant fluid. Apparatus 132 can include, for example, an adsorbent material bed that binds particles of the refrigerant fluid vapor, trapping the refrigerant fluid within apparatus 132 and preventing discharge. The adsorptive process can sequester the refrigerant fluid particles within the adsorbent material bed, which can then be removed from apparatus 132 and sent for disposal.

In some embodiments, where the refrigerant fluid is flammable, refrigerant processing apparatus 132 can be implemented as an incinerator. Incoming refrigerant fluid vapor can be mixed with oxygen or another oxidizing agent and ignited to combust the refrigerant fluid. The combustion products can be discharged from the incinerator or collected (e.g., via an adsorbent material bed) for later disposal.

As an alternative, refrigerant processing apparatus 132 can also be implemented as a combustor of an engine or another mechanical power-generating device. Refrigerant fluid vapor from conduit 28 can be mixed with oxygen, for example, and combusted in a piston-based engine or turbine to perform mechanical work, such as providing drive power for a vehicle or driving a generator to produce electricity. In certain embodiments, the generated electricity can be used to provide electrical operating power for one or more devices, including thermal load 20. For example, thermal load 20 can include one or more electronic devices that are powered, at least in part, by electrical energy generated from combustion of refrigerant fluid vapor in refrigerant processing apparatus 132.

As shown in FIGS. 12A and 12B, the thermal management systems disclosed herein can optionally include a phase separator 134 upstream from the refrigerant processing apparatus 132. In FIG. 12A, phase separator 134 is also downstream from second control device 18, while in FIG. 12B, separator 134 is upstream from second control device 18. Phase separator 134 can be present in addition to, or as an alternative to, phase separator 20*a* and/or phase separator 120*a*.

Particularly during start-up of the systems disclosed herein, liquid refrigerant may be present in conduits 26 and/or 28, because the systems generally begin operation before heat load 20 and/or heat load 94 are activated. Accordingly, phase separator 134 functions in a manner similar to phase separators 20*a* and 120*a* described above, to separate liquid refrigerant fluid from refrigerant vapor. The separated liquid refrigerant fluid can be re-directed to another portion of the system, or retained within phase separator 134 until it is converted to refrigerant vapor. By using phase separator 134, liquid refrigerant fluid can be prevented from entering refrigerant processing apparatus 132.

V. Integration with Power Systems

In some embodiments, the refrigeration systems disclosed herein can combined with power systems to form integrated power and thermal systems, in which certain components of the integrated systems are responsible for providing refrigeration functions and certain components of the integrated systems are responsible for generating operating power.

Figure 13:
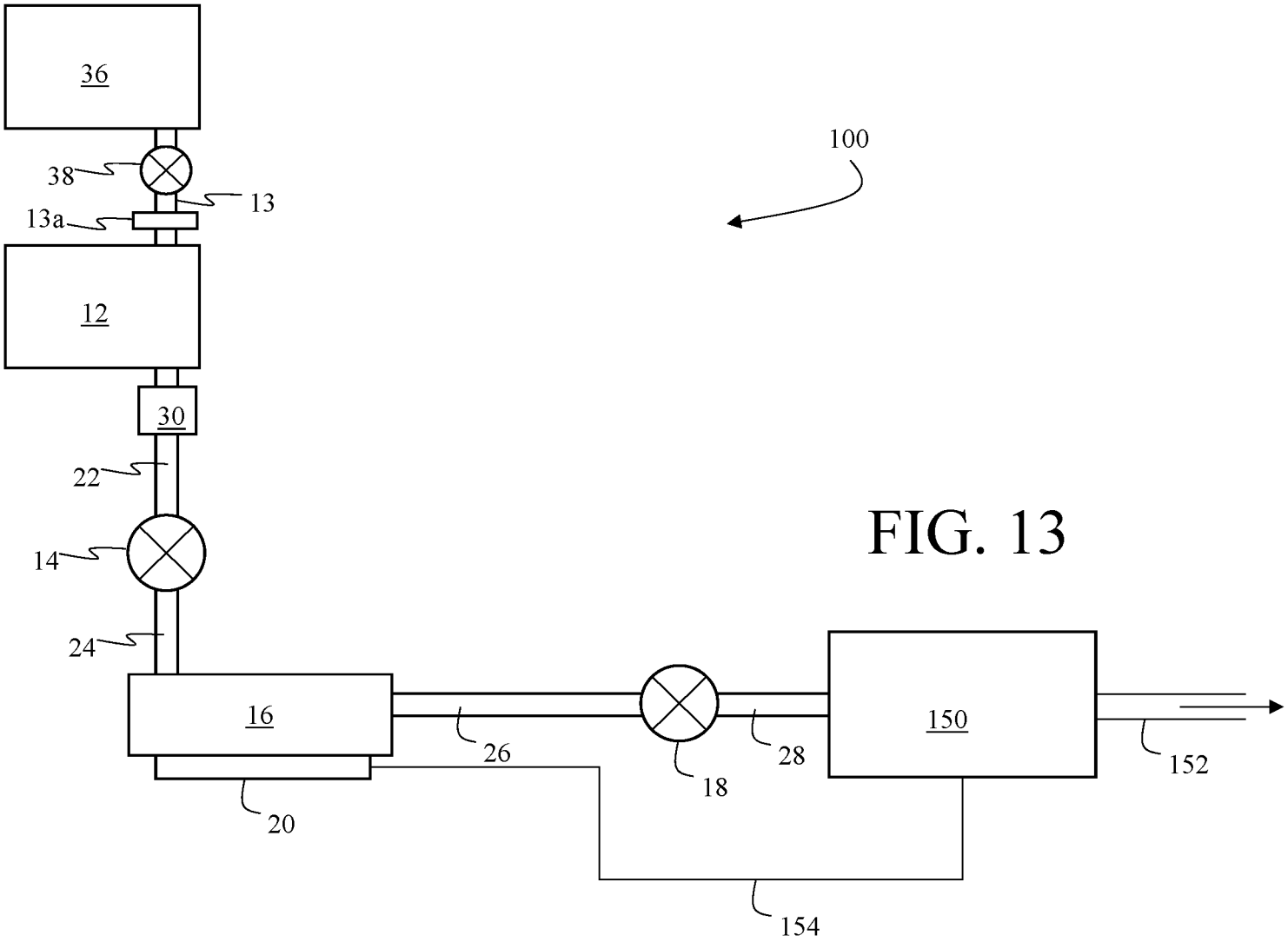
FIG. 13 is a schematic diagram of an example of a thermal management system that includes a power generation apparatus.

FIG. 13 shows an integrated power and thermal management system 100 that includes an OCRS having many features similar to those discussed above. In addition, system 100 includes an engine 150 with an inlet that receives the stream of waste refrigerant fluid that enters conduit 28 after passing through second control device 18. Engine 150 can combust the waste refrigerant fluid directly, or alternatively, can mix the waste refrigerant fluid with one or more additives (such as oxidizers) before combustion. Where ammonia is used as the refrigerant fluid in system 100, suitable engine configurations for both direct ammonia combustion as fuel, and combustion of ammonia mixed with other additives, can be implemented. In general, combustion of ammonia improves the efficiency of power generation by the engine.

The energy released from combustion of the refrigerant fluid can be used by engine 150 to generate electrical power, e.g., by using the energy to drive a generator. The electrical power can be delivered via electrical connection 154 to thermal load 20 to provide operating power for the load. For example, in certain embodiments, thermal load 20 includes one or more electrical circuits and/or electronic devices, and engine 150 provides operating power to the circuits/devices via combustion of refrigerant fluid. Byproducts of the combustion process can be discharged from engine 150 via exhaust conduit 152, as shown in FIG. 13.

Various types of engines and power-generating devices can be implemented as engine 150 in system 110*a*. In some embodiments, for example, engine 150 is a conventional four cycle piston-based engine, and the waste refrigerant fluid is introduced into a combustor of the engine. In certain embodiments, engine 150 is a gas turbine engine, and the waste refrigerant fluid is introduced via the engine inlet to the afterburner of the gas turbine engine.

As discussed above in connection with FIGS. 12A and 12B, in some embodiments, system 1300 can include phase separator 134 positioned upstream from engine 150 and either downstream or upstream from second control device 18. Phase separator 134 functions to prevent liquid refrigerant fluid from entering engine 150, which may reduce the efficiency of electrical power generation by engine 150.

VI. Start-Up and Temporary Operation

In certain embodiments, the thermal management systems disclosed herein operate differently at, and immediately following, system start-up, compared to the manner in which the systems operate after an extended running period. Upon start-up, refrigerant fluid in refrigerant receiver 12 may be relatively cold, and therefore the receiver pressure ($p_r$) may be lower than a typical receiver pressure during extended operation of the system. However, if receiver pressure $p_r$ is too low, the system may be unable to maintain a sufficient mass flow rate of refrigerant fluid through evaporator 16 to adequately cool thermal load 20.

As discussed in connection with FIG. 2, however, gas supplied by gas receiver 36 can be used to maintain the receiver pressure in refrigerant receiver 12, ensuring smooth start-up and allowing the system to deliver refrigerant fluid into evaporator 16 at a sufficient mass flow rate.

VII. Integration with Directed Energy Systems

The thermal management systems and methods disclosed herein can implemented as part of (or in conjunction with) directed energy systems such as high energy laser systems. Due to their nature, directed energy systems typically present a number of cooling challenges, including certain heat loads for which temperatures are maintained during operation within a relatively narrow range.

Figure 14:
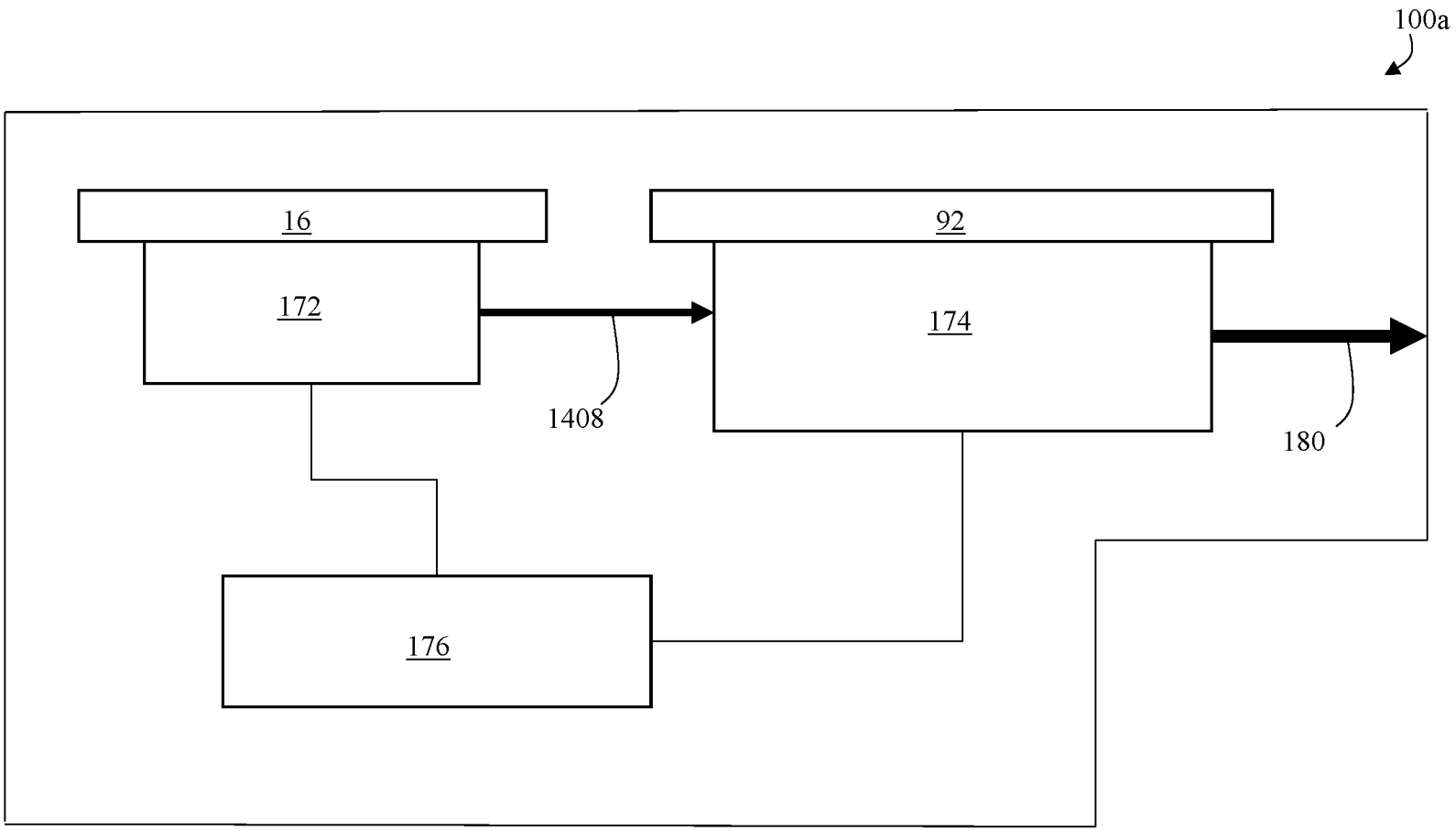
FIG. 14 is a schematic diagram of an example of directed energy system that includes a thermal management system.

FIG. 14 shows one example of a directed energy system, specifically, a high energy laser system 100*a*. System 100*a* includes a bank of one or more laser diodes 172 and an amplifier 174 connected to a power source 176. During operation, laser diodes 172 generate an output radiation beam 178 that is amplified by amplifier 174, and directed as output beam 180 onto a target. Generation of high energy output beams can result in the production of significant quantities of heat. Certain laser diodes, however, are relatively temperature sensitive, and the operating temperature of such diodes is regulated within a relatively narrow range of temperatures to ensure efficient operation and avoid thermal damage. Amplifiers are also temperature-sensitively, although typically less sensitive than diodes. To regulate the temperatures of various components of directed energy systems such as diodes 172 and amplifier 174, such systems can include components and features of the thermal management systems disclosed herein.

In FIG. 14, evaporator 16 is coupled to diodes 172, while heat exchanger 92 is coupled to amplifier 174. The other components of the thermal management systems disclosed herein are not shown for clarity. However, it should be understood that any of the features and components discussed above can optionally be included in directed energy systems. Diodes 172, due to their temperature-sensitive nature, effectively function as heat load 20 in system 110*a*, while amplifier 174 functions as heat load 94.

System 100*a* is one example of a directed energy system that can include various features and components of the thermal management systems and methods described herein. However, it should be appreciated that the thermal management systems and methods are general in nature, and can be applied to cool a variety of different heat loads under a wide range of operating conditions.

Figure 15:
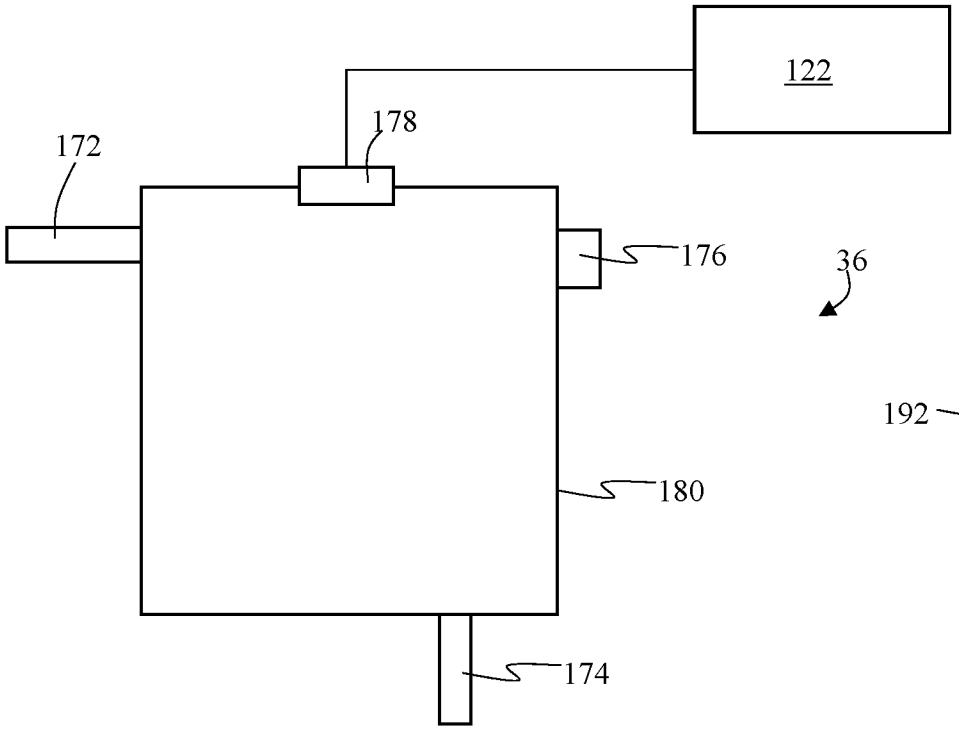
FIG. 15 is a schematic diagram of an example of gas receiver.
Figure 17:
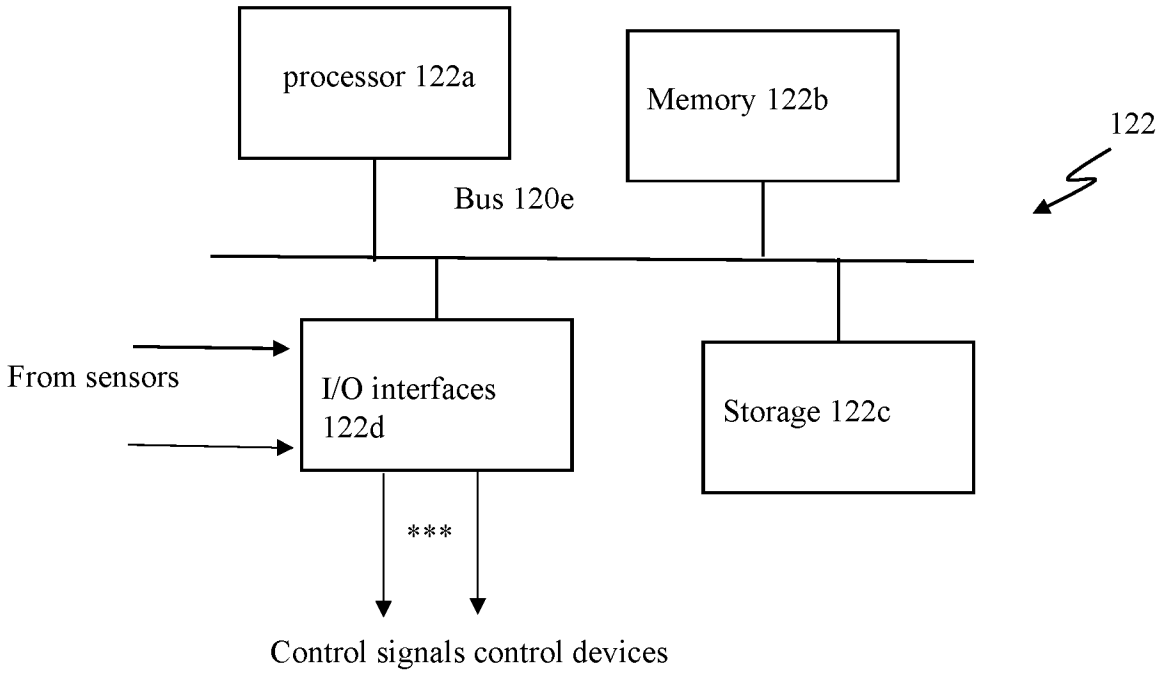
FIG. 17 is a block diagram of a controller system.

FIG. 15 shows an example of gas receiver 36 that includes a container 180, a charging port 172, an exit port 174, an optional pressure relief valve 176, and an optional pressure sensor 178. Pressure sensor 178 can optionally be connected to controller 122 via a control line, so that controller 122 can measure gas pressure information within gas receiver 36. Using this gas pressure information, for example, controller 122 can estimate the amount of gas remaining within gas receiver 36.

Gas receiver 36 is charged with one or more gases through charging port 162, and the one or more gases exit gas receiver 36 (and enter conduit 130) through exit port 174. Pressure relief valve 176, if present, permits excess gas to be discharged from container 180 if the gas pressure within container 180 exceeds a threshold value. Although ports 172 and 174 and valve 176 are shown separately in FIG. 15, in some embodiments, some or all of the ports and the valve can be implemented as a single interface to container 180

In general, container 180 can have a variety of different shapes. In certain embodiments, for example, container 180 is cylindrical. Examples of other possible shapes include, but are not limited to, rectangular prismatic, cubic, and conical.

Figure 16:
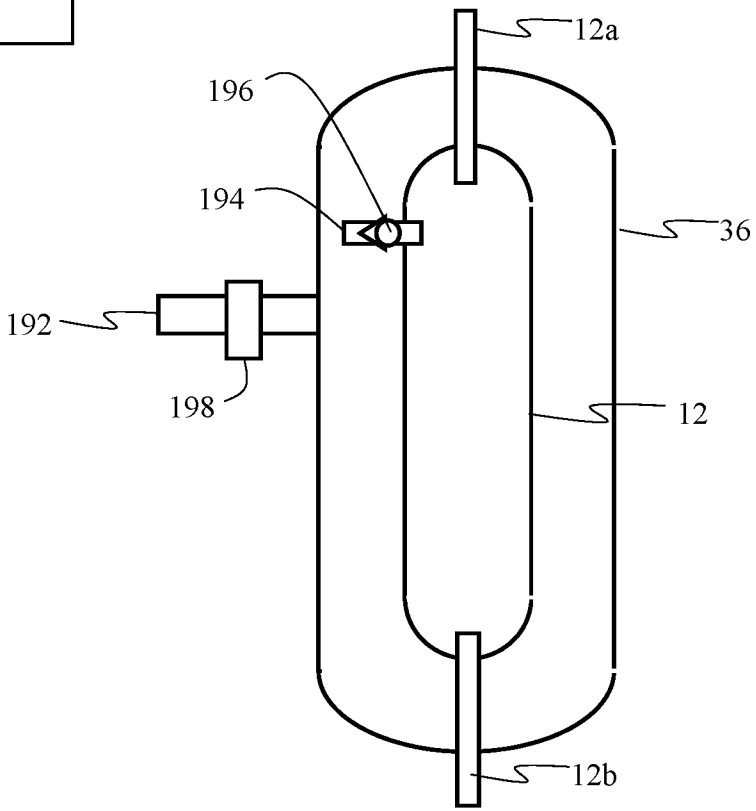
FIG. 16 is a schematic diagram of a gas receiver with an internal refrigerant receiver.

FIG. 16 shows an example of a gas receiver 36 with an internal refrigerant receiver 12. A check valve 196 is positioned in exit port 194 to ensure that refrigerant fluid does not flow backward into gas receiver 36 from refrigerant receiver 12. Refrigerant fluid leaves refrigerant receiver 12 through outlet 12*b*. Refrigerant receiver 12 is charged with refrigerant fluid through inlet 12*a*, while gas receiver 36 is charged with gas through charging port 192. An optional pressure sensor 198 can be used to measure the pressure in the receivers.

VIII. Hardware and Software Implementations

Controller 122 can generally be implemented as any one of a variety of different electrical or electronic computing or processing devices, and can perform any combination of the various steps discussed above to control various components of the disclosed thermal management systems.

Controller 122 can generally, and optionally, include any one or more of a processor (or multiple processors) 122*a*, a memory 122*b*, a storage device 122*c*, and input/output device 122*d*. Some or all of these components can be interconnected using a system bus 122*e*. The processor is capable of processing instructions for execution. In some embodiments, the processor can be a single-threaded processor. In certain embodiments, the processor can be is a multi-threaded processor. Typically, the processor is capable of processing instructions stored in the memory or on the storage device to display graphical information for a user interface on the input/output device, and to execute the various monitoring and control functions discussed above. Suitable processors for the systems disclosed herein include both general and special purpose microprocessors, and the sole processor or one of multiple processors of any kind of computer or computing device.

The memory 122*b* stores information within the system, and can be a computer-readable medium, such as a volatile or non-volatile memory. The storage device 122*c* can be capable of providing mass storage for the controller 122. In general, the storage device 122*c* can include any non-transitory tangible media configured to store computer readable instructions. For example, the storage device can include a computer-readable medium and associated components, including: magnetic disks, such as internal hard disks and removable disks; magneto-optical disks; and optical disks. Storage devices 122*c* suitable for tangibly embodying computer program instructions and data include all forms of non-volatile memory, including by way of example semiconductor memory devices, such as EPROM, EEPROM, and flash memory devices; magnetic disks such as internal hard disks and removable disks; magneto-optical disks; and CD-ROM and DVD-ROM disks. Processors and memory units of the systems disclosed herein can be supplemented by, or incorporated in, ASICs (application-specific integrated circuits).

The input/output device 122*d* provides input/output operations for controller 122, and can include a keyboard and/or pointing device. In some embodiments, the input/output device includes a display unit for displaying graphical user interfaces and system related information. Not shown, but which could be includes is one or more network interfaces.

The features described herein, including components for performing various measurement, monitoring, control, and communication functions, can be implemented in digital electronic circuitry, or in computer hardware, firmware, or in combinations of them. Methods steps can be implemented in a computer program product tangibly embodied in an information carrier, e.g., in a machine-readable storage device, for execution by a programmable processor (e.g., of controller 122), and features can be performed by a programmable processor executing such a program of instructions to perform any of the steps and functions described above. Computer programs suitable for execution by one or more system processors include a set of instructions that can be used, directly or indirectly, to cause a processor or other computing device executing the instructions to perform certain activities, including the various steps discussed above.

Computer programs suitable for use with the systems and methods disclosed herein can be written in any form of programming language, including compiled or interpreted languages, and can be deployed in any form, including as stand-alone programs or as modules, components, subroutines, or other units suitable for use in a computing environment.

In addition to one or more processors and/or computing components implemented as part of controller 122, the systems disclosed herein can include additional processors and/or computing components within any of the control device (e.g., first control device 14 and/or second control device 18) and any of the sensors discussed above. Processors and/or computing components of the control device and sensors, and software programs and instructions that are executed by such processors and/or computing components, can generally have any of the features discussed above in connection with controller 122.

Other Embodiments

A number of embodiments have been described. Nevertheless, it will be understood that various modifications may be made without departing from the spirit and scope of the disclosure. Accordingly, other embodiments are within the scope of the following claims.

What is claimed is:

1. A thermal management system, comprising:

an open circuit refrigeration system that has a refrigerant fluid flow path, with the refrigerant fluid flow path comprising:

a first receiver configured to store an inert gas;

a second receiver configured to store a liquid refrigerant fluid, with the second receiver coupled to the first receiver, and with the second receiver further configured to receive the inert gas from the first receiver, so as to maintain the liquid refrigerant fluid in a sub-cooled state;

an evaporator coupled to the second receiver, the evaporator configured to extract heat from a heat load that contacts the evaporator; and an exhaust line.

2. The system of claim 1, further comprising:

a first control device configurable to control a vapor quality of the refrigerant fluid at an outlet of the evaporator.

3. The system of claim 2, further comprising:

a second control device configurable to control a temperature of the heat load, the second control device coupled between an outlet of the evaporator and the exhaust line.

4. The system of claim 3, further comprising:

a third control device that is configurable to control a flow of the inert gas from the first receiver to the second receiver to regulate a vapor pressure in the second receiver.

5. The system of claim 4 wherein the third control device is configurable to maintain a target vapor pressure in the second receiver during operation of the system.

6. The system of claim 4, further comprising:

a first measurement apparatus configured to adjust the first control device based on a first thermodynamic attribute of the system; and a second measurement apparatus configured to adjust the second control device based on a second, different thermodynamic attribute of the system.

7. The system of claim 6 wherein the first measurement apparatus comprises a member connected between the first control device and a first location along the refrigerant fluid flow path and configured to mechanically adjust the first control device, and the first control device comprises a first actuation assembly that is adjustable by the member.

8. The system of claim 6 wherein the first measurement apparatus comprises one or more refrigerant fluid pressure sensors that are configured to generate one or more electrical signals corresponding to a pressure of refrigerant fluid in contact with the one or more refrigerant fluid pressure sensors, and the first control device comprises an actuation assembly that is adjustable based on the one or more electrical signals generated by the one or more refrigerant fluid pressure sensors.

9. The system of claim 8 wherein the one or more refrigerant fluid pressure sensors are positioned to measure refrigerant fluid pressure at one or more locations in the system and to generate the one or more electrical signals that represent one or more of a refrigerant fluid pressure adjacent to an outlet of the evaporator, a refrigerant fluid pressure adjacent to an outlet of the first control device, a refrigerant fluid pressure difference across the first control device, and a refrigerant fluid pressure difference across the evaporator.

10. The system of claim 6, wherein the second measurement apparatus comprises one or more refrigerant fluid pressure sensors that are configured to generate one or more electrical signals corresponding to a pressure of refrigerant fluid in contact with the one or more sensors, and the second control device comprises an actuation assembly that is adjustable based on the one or more electrical signals generated by the one or more refrigerant fluid pressure sensors.

11. The system of claim 10 wherein the one or more refrigerant fluid pressure sensors are positioned to measure refrigerant fluid pressure at one or more locations in the system and to generate the one or more electrical signals that represent one or more of a refrigerant fluid pressure adjacent to an outlet of the evaporator, a refrigerant fluid pressure adjacent to an outlet of the second control device, a refrigerant fluid pressure difference across the second control device, and a refrigerant fluid pressure difference across the evaporator.

12. The system of claim 3 wherein the second control device is connected downstream from the evaporator along the refrigerant fluid flow path.

13. The system of claim 3 wherein the second control device comprises a back pressure regulator.

14. The system of claim 13 wherein the back pressure regulator is configured to receive refrigerant fluid vapor generated in the evaporator and to regulate a pressure of the refrigerant fluid upstream from the back pressure regulator along the refrigerant fluid flow path.

15. The system of claim 14 wherein the back pressure regulator is further configured to perform an expansion of the refrigerant fluid vapor.

16. The system of claim 2 wherein the first control device is configurable to receive liquid refrigerant fluid from the second receiver at a first pressure, expand the liquid refrigerant fluid to generate a refrigerant fluid mixture at a second pressure that comprises liquid refrigerant fluid and refrigerant fluid vapor, and direct the refrigerant fluid mixture into the evaporator.

17. The system of claim 16 wherein the first control device comprises:

an expansion valve.

18. The system of claim 16 wherein the first control device is configured to perform a constant-enthalpy expansion of the liquid refrigerant fluid to generate the refrigerant fluid mixture.

19. The system of claim 1, further comprising:

a flow control device positioned between the first receiver and the second receiver, and configurable to prevent flow of the liquid refrigerant fluid from the second receiver to the first receiver.

20. The system of claim 1 wherein the liquid refrigerant fluid comprises ammonia.

21. The system of claim 1 wherein the inert gas does not react chemically with the refrigerant fluid.

22. The system of claim 1 wherein the inert gas comprises at least one gas selected from the group consisting of nitrogen, argon, xenon, and helium.

23. A thermal management method, comprising:

transporting a refrigerant fluid along a refrigerant fluid flow path that extends from a refrigerant receiver through an evaporator to an exhaust line;

extracting heat from a heat load in contact with the evaporator;

transporting an inert gas from a gas receiver to the refrigerant receiver at least prior to transporting or during transporting of the refrigerant fluid to control a vapor pressure in the refrigerant receiver; and discharging the refrigerant fluid from the exhaust line so that the discharged refrigerant fluid is not returned to the refrigerant fluid flow path.

24. The method of claim 23 wherein transporting the inert gas is responsive to changes in pressure in the refrigerant receiver.

25. The method of claim 23, further comprising:

regulating a vapor quality of the refrigerant fluid at an outlet of the evaporator, and a temperature of the heat load.

26. The method of claim 23, further comprising:

regulating a flow of the inert gas from the gas receiver to the refrigerant receiver to maintain the vapor pressure in the refrigerant receiver at or above a target pressure.

27. The method of claim 26, further comprising:

discharging the inert gas along a gas flow path between the gas receiver and the refrigerant receiver when the vapor pressure in the refrigerant receiver exceeds the target pressure.

28. The method of claim 26, further comprising:

increasing a gas flow rate between the gas receiver and the refrigerant receiver when the vapor pressure in the refrigerant receiver is less than the target pressure.

29. The method of claim 23, further comprising:

expanding liquid refrigerant fluid from the refrigerant receiver to generate a refrigerant fluid mixture comprising liquid refrigerant fluid and refrigerant fluid vapor; and directing the refrigerant fluid mixture into the evaporator.

30. The method of claim 23 wherein the refrigerant fluid comprises ammonia.

31. The method of claim 23 wherein the inert gas does not react chemically with the refrigerant fluid.

32. The method of claim 23 wherein the inert gas comprises at least one gas selected from the group consisting of nitrogen, argon, xenon, and helium.

33. The method of claim 23, further comprising:

regulating a pressure of the refrigerant fluid upstream from the exhaust line along the refrigerant fluid flow path.

34. The method of claim 33, further comprising:

regulating vapor quality of the refrigerant fluid at the outlet of the evaporator based on a refrigerant fluid pressure corresponding to one or more of a refrigerant fluid pressure adjacent to an outlet of the evaporator, a refrigerant fluid pressure adjacent to an outlet of a control device upstream from the evaporator, a refrigerant fluid pressure difference across the control device, and a refrigerant fluid pressure difference across the evaporator.

35. The method of claim 33, further comprising:

regulating temperature of the heat load based on a refrigerant fluid pressure corresponding to one or more of a refrigerant fluid pressure adjacent to an outlet of the evaporator, a refrigerant fluid pressure adjacent to an outlet of a control device upstream from the evaporator, a refrigerant fluid pressure difference across the control device, and a refrigerant fluid pressure difference across the evaporator.

36. The method of claim 23, further comprising:

regulating vapor quality of the refrigerant fluid at the outlet of the evaporator based on thermodynamic properties of the refrigerant fluid emerging from an outlet of the evaporator.

37. The method of claim 23, further comprising:

regulating temperature of the heat load based on thermodynamic properties of the refrigerant fluid emerging from an outlet of the evaporator.

38. The method of claim 23, further comprising:

adjusting the vapor pressure in the refrigerant receiver to regulate a flow rate of the refrigerant fluid through the evaporator to control vapor quality of the refrigerant fluid at the outlet of the evaporator.

39. The method of claim 23, further comprising:
adjusting the vapor pressure in the refrigerant receiver to control the temperature of the heat load.

* * * * *